US007530322B2

(12) United States Patent
Angelini

(10) Patent No.: US 7,530,322 B2
(45) Date of Patent: May 12, 2009

(54) BOAT FOLDABLE INTO A COMPACT SELF-CONTAINED SHAPE

(76) Inventor: Joseph A. Angelini, 9819 Harin Ridge Way, Knoxville, TN (US) 37931

( * ) Notice: Subject to any disclaimer, the term of this patent is extended or adjusted under 35 U.S.C. 154(b) by 0 days.

(21) Appl. No.: 11/767,048

(22) Filed: Jun. 22, 2007

(65) Prior Publication Data

US 2008/0006198 A1 Jan. 10, 2008

Related U.S. Application Data

(60) Provisional application No. 60/805,739, filed on Jun. 24, 2006.

(51) Int. Cl.
*B63B 7/00* (2006.01)
*B63H 16/20* (2006.01)

(52) U.S. Cl. ..... 114/353; 440/26

(58) Field of Classification Search ..... 114/353
See application file for complete search history.

(56) References Cited

U.S. PATENT DOCUMENTS 1,932,245 A * 10/1933 Horak ..... 114/354
2,880,429 A 4/1959 Henry
2,969,511 A 1/1961 Snider
3,060,464 A 10/1962 Robinson
3,594,834 A * 7/1971 Steensen ..... 114/353
3,771,180 A 11/1973 Tanabe
4,225,551 A 9/1980 Gault
4,697,540 A 10/1987 Graham
4,706,597 A 11/1987 Figone
4,979,916 A * 12/1990 LeBlanc ..... 440/27
5,009,184 A * 4/1991 Voldrich ..... 114/361
5,203,276 A 4/1993 Methven
5,257,594 A 11/1993 Methven
5,372,085 A 12/1994 Kaye
5,651,706 A 7/1997 Kasper
5,957,080 A 9/1999 Ovard
5,975,005 A 11/1999 Yoshioka
6,615,762 B1 9/2003 Scott
6,766,758 B1 7/2004 Zoss

* cited by examiner

*Primary Examiner*—Jesus D Sotelo
(74) *Attorney, Agent, or Firm*—Knox Patent; Thomas A. Kulaga

(57) ABSTRACT

An apparatus with two configurations: a deployed configuration forming a watercraft that floats in water and a folded configuration that allows for transport of the apparatus. The apparatus includes multiple modules. One module is a planar sheet of corrugated material with a plurality of joints that allow the sheet to assume the shape of a hull when in the deployed configuration and to assume a box-shape when in the folded configuration. Another module is a paddle assembly that is releaseably connected to a pair of sidewalls when the sheet is in the deployed configuration. The paddle assembly is foldable such that it fits within the box-shape when the sheet is in the folded configuration. The planar sheet is foldable around a plurality of joints or hinges that are configured to fold two ways, thereby allowing the sheet to assume the two configurations.

19 Claims, 16 Drawing Sheets

BOAT FOLDABLE INTO A COMPACT SELF-CONTAINED SHAPE

CROSS-REFERENCE TO RELATED APPLICATIONS

This application claims the benefit of U.S. Provisional Application Ser. No. 60/805,739, filed Jun. 24, 2006.

STATEMENT REGARDING FEDERALLY SPONSORED RESEARCH OR DEVELOPMENT

Not Applicable

BACKGROUND OF THE INVENTION

1. Field of Invention

This invention pertains to a watercraft in which the hull folds into a suitcase shape. More particularly, this invention pertains to a watercraft in which the hull is formed of a planar sheet that is divided into sections that are joined at integral hinges. The planar sheet is a corrugated material and the hinges are cut or formed into the material. In various configurations, the watercraft includes a canopy, a paddle drive system, a folding built-in seat with integral rudder control, and various hull shapes.

2. Description of the Related Art

Boats, or more generally, watercraft or water vessels, have been in use throughout the history of mankind. Traditionally, boats are big and bulky, typically sized to hold one or more persons. By their nature, boats are rigid, or sufficiently so, to maintain their shape when in the water carrying persons and/or cargo. With the advent of more leisure time, recreational use of boats has increased. To facilitate recreational use, there is a desire to have boats that are easily transportable.

Various attempts have been made to have boats that are useable in the water and collapsible or foldable for easy transport to the water. The following patents describe some of these attempts:

U.S. Pat. No. 2,880,429, titled "Collapsible boats," discloses a boat formed from a single sheet. The sheet includes multiple members hinged together such that the members fold into a boat. In the example given in the patent, the members are sandwiched between inner and outer sheets 29, 30. The gap between the members acts as a hinge.

U.S. Pat. No. 3,771,180, titled "Collapsible portable boat and its method of assembly," discloses a light weight, high buoyancy boat made of corrugated thermoplastic synthetic resin sheets 10, 20, 30. Lines or creases are pressed onto the sheets for folding. In addition to the sheets 10, 20, 30, reinforcing materials 41 are used. The boat includes a vessel portion or a main body. Attached to the main body is a float portion.

U.S. Pat. No. 4,225,551, titled "Boat hulls," discloses a process for forming a thermoplastic sheet material into a boat hull. The process forms fold lines in a sheet 10. The fold lines have memory and cause the sheet 10 to assume a folded shape. The sheet 10 is readily rolled into a compact package for transportation. When it is unrolled it again tends to assume its folded shape from the memory built into the fold lines.

U.S. Pat. No. 4,697,540, titled "Collapsible foldaway dinghy," discloses a synthetic single skin 12 having panels joined by flexible watertight webs. The dinghy 10 can be folded into a small package that fits in a car trunk.

U.S. Pat. No. 4,706,597, titled "Seamless foldable boat," discloses a boat hull formed from a one piece mold. The hull is a plastic or elastomeric material with foam core construction. The hull bottom includes intrinsically hinged bottom areas 23 between foamed core members. The sides of the hull includes foam cored sides 26 connected to side membranes 25. To provide rigidity, various other members 28, 29, 30 are attached to the one piece hull.

U.S. Pat. No. 5,203,276, titled "Suitcase boat," discloses a pontoon boat 10 having four sections 16, 18 connected by hinges 22. The boat 10 folds into a suitcase-type configuration with the pontoons, or floats, 24 fitting inside the folded boat sections. U.S. Pat. No. 5,257,584, is a continuation-in-part of the suitcase boat 10 patent application.

U.S. Pat. No. 5,651,706, titled "Collapsible pontoon pedal boat," discloses a watercraft with a body, two inflatable flotation members, a drive assembly, a steering assembly, and a seat. The body portion folds to form a compact storage case that accommodates all the elements of the watercraft. FIG. 9 illustrates the watercraft in the folded position.

U.S. Pat. No. 5,957,080, titled "Folding portable boat," discloses a boat 10 with four rigid hull sections 12, 13, 14, 15 that are hingedly connected to fold together or to open into a boat 10. The sections are made of flotation material 61 that is covered with a skin, such as fiberglass, aluminum, thermoplastic, or from a woven structure/resin transfer molding other than fiberglass.

U.S. Pat. No. 5,975,005, titled "Foldable boat," discloses a boat having an outer hull plate 1 and a waterproofing member 2 that covers the outer hull plate 1. Hull-forming members 10*a-h* are plank-like members that are connected together by flexible members 3. Tightening the flexible members 3 causes the hull-forming members 10 to form a rigid hull, and loosening the flexible members 3 allows the hull-forming members 10 to fold together accordion-like.

U.S. Pat. No. 6,615,762, titled "Foldable boat with light weight hull construction system," discloses a boat made with extruded corrugated plastic. The boat hull 47 is formed of sections 8-15 that are flat blank hull sections with fastener holes 49 and hinge score lines 50. The flat blank hull section is folded into the desired shape at the score lines 50, which form living hinges.

U.S. Pat. No. 6,766,758, titled "Folding boat," discloses a folding boat 10 having a deck 12, safety fences 26, and pontoons 28. The deck 12 includes two main panels connected with a hinge 14 and several drop leaf panels 16 that are hingedly connected to the main panels. Folding the two halves of the deck 12 forms a compact structure.

BRIEF SUMMARY OF THE INVENTION

According to one embodiment of the present invention, a boat that is constructed such that the boat folds into a self-contained shape is provided. In one embodiment, the boat has four modules: the hull, the seat, the paddle assembly, and the canopy. The modules are separable and collapsible. When deployed, in one embodiment, the hull assumes the general shape of pram, and, in another embodiment, the hull has a more pointed, blunt-nosed, bow. When folded, the boat assumes the shape of box with two open ends that are opposite each other.

In one embodiment, the hull, when deployed, has the general shape of a pram, that is, it has a flat-bottom, a square stern, and a forward sloping square bow. The hull is made of a single corrugated plastic sheet, which in one embodiment is an extruded twin-wall plastic sheet of high impact polypropylene copolymer, such as Coroplast. The various joints formed in the copolymer resin allows the hull material to flex and act as a hinge without breaking or cracking.

The hull is formed from a single corrugated plastic sheet with various connectors attached to the sheet. Three types of fold lines, or joints, are formed in the sheet. The first type of joint is a channel cut joint in which one surface or wall of the sheet is cut away and the length of the exposed flutes are reduced by approximately one-half. The second type of joint is a half-cut joint in which one surface of the sheet is cut such that the opposite surface is the only connection between the two halves of the sheet. The half-cut joint includes a parallel flute half-cut joint in which the one surface is cut parallel with the flutes. Another type of half-cut joint is a cross-flute half-cut joint in which the cut in the one surface of the sheet crosses the flutes, which are also cut down to the opposite surface of the sheet. The third type of joint is a face cut joint in which one surface of the sheet is removed and the flutes between the removed surface and the opposite surface are also removed, leaving only the opposite surface of the sheet.

The hull has various joints to allow a single sheet to fold to form the hull and to also fold into a box-shape. A face cut joint is made at each of the four corners of the sheet forming the hull. A pair of fore-to-aft parallel flute half-cut joints are made to allow the port and starboard walls of the hull to fold up. A channel cut joint is made in the bottom of the sheet at the bottom of the transom across the width of the sheet. Four additional channel cut joints parallel to the transom channel cut joint are made on the bottom of the sheet. To form the hull, the transom is lifted up to form approximately a right angle with the remainder of the sheet, the port and starboard walls are lifted up to form approximately a right angle with the sheet portion that forms the deck, and the bow section of the deck is lifted up until the extreme forward end is even with the tops of the port and starboard walls. Each of the four top corners of the open hull are then fixed. In one embodiment, a pair of studs protrude from each top corner and the studs are held in fixed relation to each other with a linking member.

The seat attaches to the hull and allows the operator to maintain a comfortable position in the vessel. The seat includes a frame that attaches to connectors on the hull. The frame, in one embodiment, supports arm rests and the seat back. The seat bottom rests on the bottom inside surface of the hull. The arm rests, seat back, and seat bottom are formed of a foam that provides support and comfort to the seat occupant. In addition, the foam provides flotation when the boat is deployed.

In one embodiment, a tiller is attached to the seat. The tiller has a hand-grip at one end that allows the tiller to rotate. The opposite end of the tiller from the hand-grip is attached to a rudder that is mounted to the side of the hull. The rudder has a shaft that fits in a sleeve bearing mounted on the hull. The top of the shaft includes a link that connects to the tiller.

In the folded position, the seat bottom folds flat against the seat back and the two rotate to be substantially parallel with the arm rests. With this configuration, the seat occupies minimal space.

The paddle assembly provides motive force for the boat. The paddle assembly includes a crankshaft with pedals positioned in front of the seat. The crankshaft rotates within bearing assemblies attached to connectors mounted on the hull. The ends of the crankshaft have paddles that rotate with the crankshaft. In one embodiment, each paddle includes two struts, each with a blade on each end. The outboard strut attaches to an inside shaft and the inboard strut attaches to a hollow shaft. The inside shaft rotates within the hollow shaft. The inside and hollow shafts attach to one end of crankshaft, and they are fixed to the crankshaft by a pin that engages an opening in the inside and hollow shafts and the crankshaft end. The openings are aligned such that, with the pin in place, the struts are substantially perpendicular to each other when viewed from the side. In another embodiment, each paddle includes a single strut with a blade on each end of the strut.

In one embodiment, in the folded position, the pair of paddles detach from the crankshaft. The struts of each paddle rotate such that they are positioned in one plane.

In another embodiment, the boat does not use a paddle assembly for motive power and the connectors mounted on the hull to which the crankshaft would attach receive a support strut or cross-member. The support strut adds rigidity to the deployed hull by maintaining the sidewalls at a fixed distance and relationship, that is, parallel sidewalls perpendicular to the deck. In one such embodiment, the transom of the hull is configured to receive an outboard motor.

The canopy, when deployed, attaches to the hull to protect the operator and/or passengers from the elements. The canopy is formed from a single corrugated plastic sheet with two channel cut joints positioned between the fore and aft portion of the canopy. The two joints allow the canopy to fold with each of the outboard panels adjacent opposite sides of the center panel when the canopy is in the folded position. The fore and aft ends of the canopy have a support pole at each corner that attach to a mating connector mounted on the hull. In one embodiment, the pair of support poles at each end are hingedly connected to a crosspiece such that the support poles fold flat adjacent the crosspiece. The canopy includes a pair of side curtains that provide rigidity to the top of the canopy.

The steps to fold the boat include separating the four modules. The next step is to disconnect the sidewalls from adjacent sidewalls. The sheet forming the hull is then folded such that the port and starboard walls are folded inward and positioned adjacent the deck. One of the modules, other than the hull module, is folded and placed on the partially folded hull sheet next to the bow panel. The bow panel is folded over the module. The other two modules are folded and placed adjacent the first folded module and the portion of the hull sheet enclosing the first module is folded over the other modules. The pair of studs associated with the top of the transom are connected to another pair of studs by connecting links to secure the hull in the folded position with the other modules clamped inside the folded hull. A handle is attached to the outboard end of the transom, which forms the top of the box-shape.

In one embodiment, the folded boat includes a pair of wheels and a pair of legs opposite the handle. The wheels are adapted to allow the folded boat to be rolled. The legs are positioned to allow the boat in the folded position to rest on the legs and the wheels.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An apparatus that operates on water as a vessel and is capable of folding into a compact, portable box-shape is disclosed. Water sports would be enjoyed by many more people of it were possible to easily transport a boat to the water. Many prior art boats and water vessels have rigid hulls that assume only a single shape.

The present invention is a vessel with modular construction that is very compact, totally self-contained, and lightweight.

Figure 1:
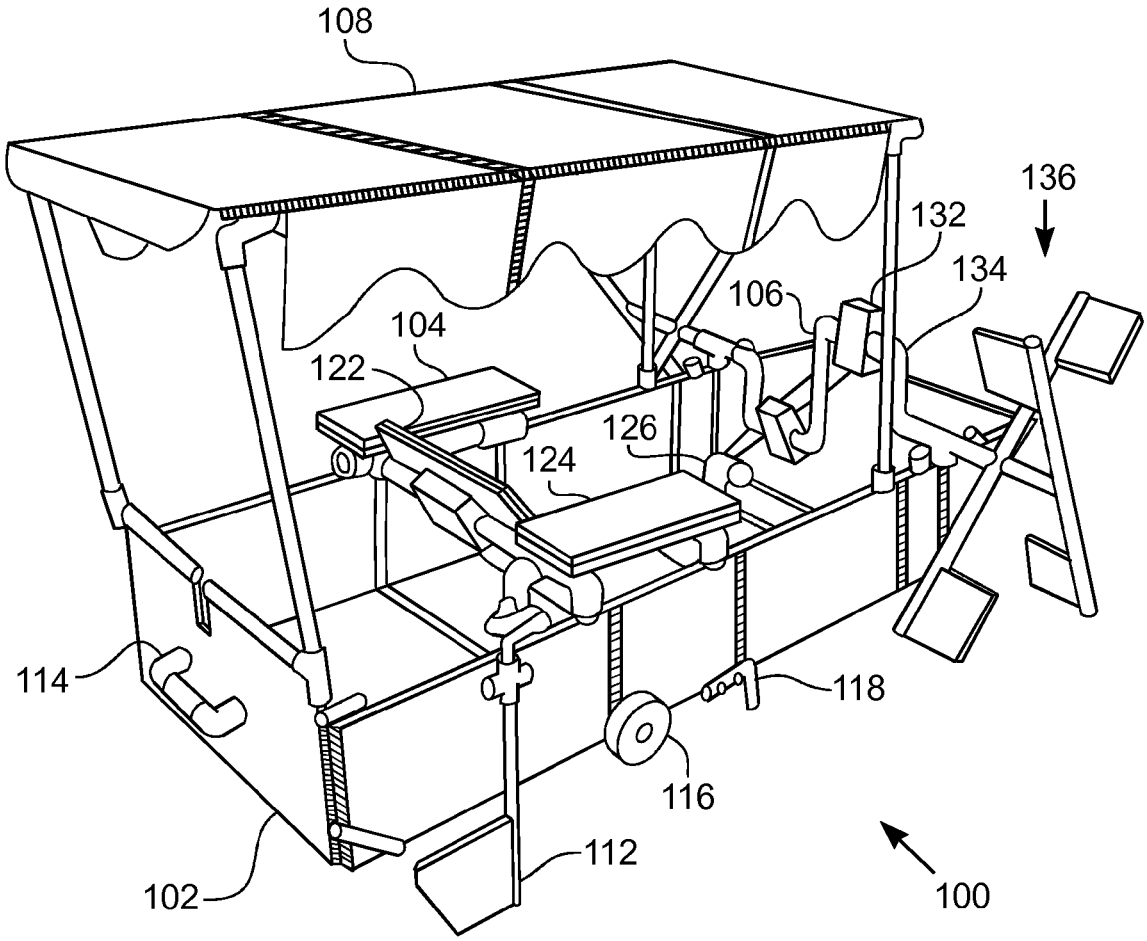
FIG. 1 is a perspective view of one embodiment of the boat.
Figure 2:
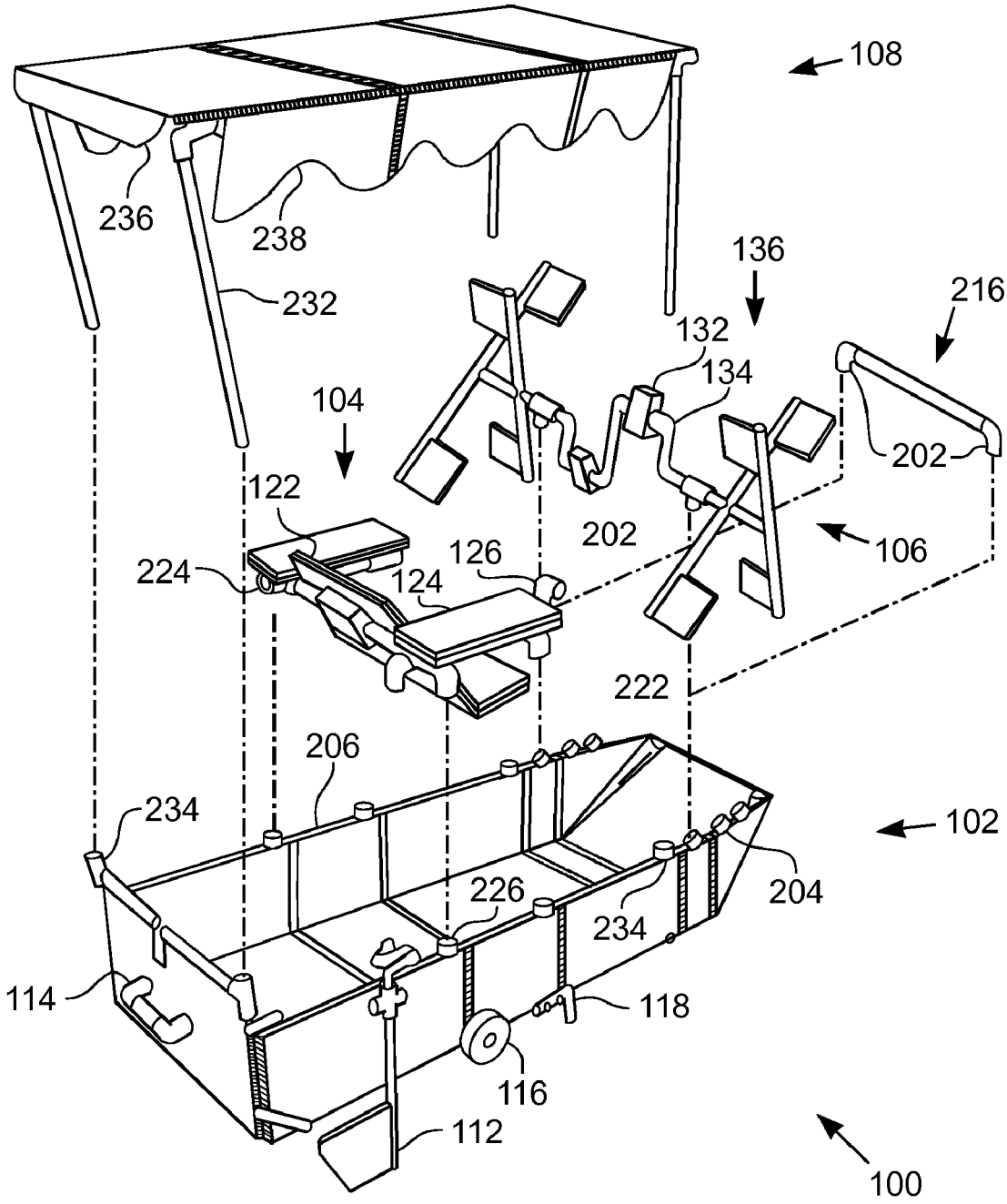
FIG. 2 is an exploded view of one embodiment of the boat.

FIG. 1 illustrates a perspective view of one embodiment of a folding boat 100. FIG. 2 illustrates an exploded view of one embodiment of the boat 100. The boat 100 has four modules: a hull 102, a seat 104, a paddle assembly 106, and a canopy 108.

In the illustrated embodiment, the hull 102 is in the deployed position and has the general shape of a pram with a flat bottom or deck 316, a square stern 310, and a square bow 304. Attached to the stern of the boat 100 is a handle 114 for use when the boat 100 is folded. Also attached to the hull 102 is a rudder assembly 112, a pair of wheels 116, and a pair of legs 118. With the boat 100 in the folded position, the wheels 116 and the legs 118 allow the folded boat 100 to be easily maneuvered by grasping the handle 114 and rolling the folded boat 100. In another embodiment, the wheels 116 and legs 118 are not attached to the hull 102 and the folded boat 100 is maneuvered by picking up and carrying the boat 100 by the handle 114.

The illustrated seat 104 includes a seat back 122 between a pair of arm rests 124. A tiller 126 is positioned adjacent one of the arm rests 124 and is releaseably and operatively connected to the rudder assembly 112. The seat back 124 and arm rests 124 are supported by a seat frame 224. Attached to the seat back 124 is a seat bottom 222 that rests on the inside bottom surface of the hull 102 when the seat 104 is in the deployed position.

The illustrated paddle assembly 106 includes a crankshaft 134 with a pair of foot-operated pedals 132. The crankshaft 134 rotates the paddles 136 positioned on opposite sides of the hull 102. In another embodiment, a hull cross-member 216 illustrated in FIG. 2 replaces the paddle assembly 106. Such an embodiment is suitable for using the boat 100 with other motive means, such as oars, paddles, or an auxiliary motor. The hull cross-member 206 connects to the hull 102 and provides support to the port and starboard walls 314-P, 314-S of the hull 102.

The illustrated canopy 108 extends from the stern of the boat 100 to near the paddle assembly 106. The canopy 108 covers the occupant of the seat 104. The canopy 108 includes side curtains 238 and a back curtain 236. Extending from the canopy 108 are four support posts 232 that attach to the hull 102. In other embodiments, the canopy 108 has a different shape and configuration and provides coverage of only a portion of the occupant of the seat 104.

The gunwales 206 of the hull 102 are the topmost edge of the hull 102 and include several connectors 204, 226, 234. The frame 224 of the seat 104 attaches to seat connectors 226 amidships. The paddle assembly 106 includes a connector half 202 that mates with a corresponding connector 204 positioned toward the bow 304. The illustrated embodiment shows a set of three paddle connectors 204 attached to each side of the hull 102. By connecting the paddle assembly 106 to one of the three pairs of connectors 204, the distance between the seat 104 and the pedals 132 on the crankshaft 134 is adjustable to fit the size of the occupant of the seat 104. In the illustrated embodiment, the three pairs of connectors 204 are angled toward the stern of the hull 102 because of the forward pressure exerted on the crankshaft 134 through the pedals 132.

The hull cross-member 216 connects to the same connectors 204 when the paddle assembly 106 is not attached to the hull 102. The cross-member 216 bridges the sidewalls 314 to maintain the sidewalls 314 in a substantially fixed position relative to each other. The paddle assembly 106 includes a crankshaft 134 that is a cross-member and serves the same purpose as the hull cross-member 216. The seat 104 also includes members that connect to the gunwales 206 and serves the same purpose as the hull cross-member 216. The support posts 232 of the canopy 108 attach to the canopy connectors 234 at the stern 310 and near the bow 304.

Figure 3:
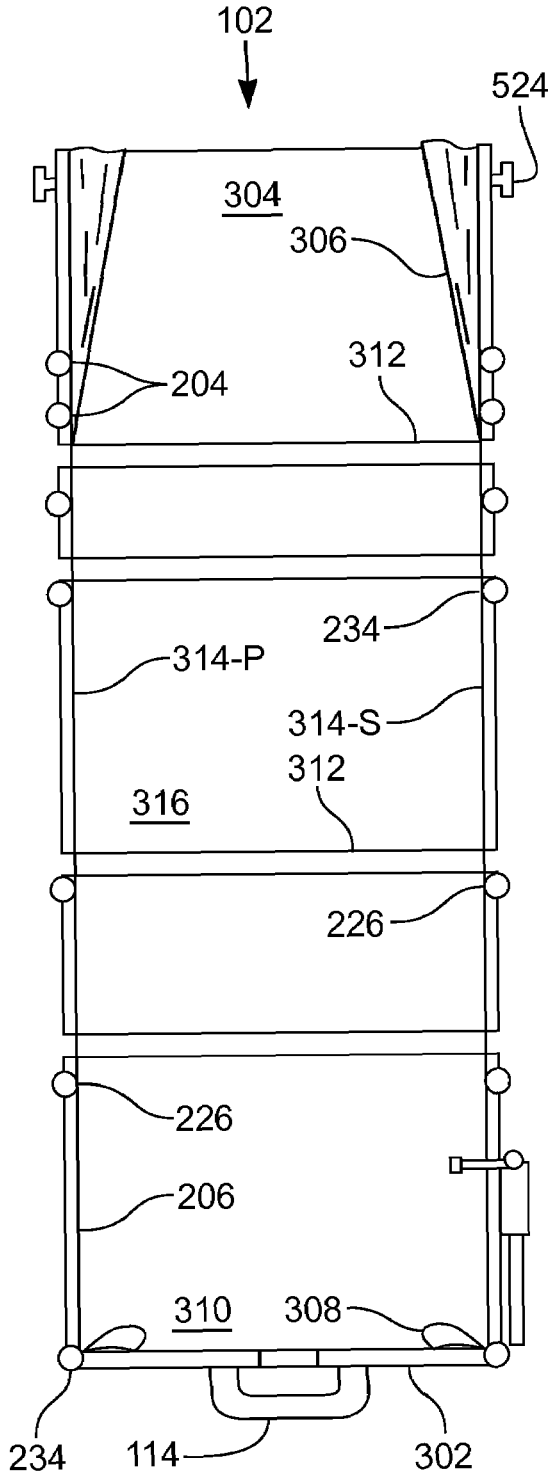
FIG. 3 is a top plan view of the hull.

FIG. 3 illustrates a top plan view of the hull 102. The hull 102 has a deck 316 defined by a bow 304 and a stern 310. The deck 316 and transom 302 are between the port wall 314-P and the starboard wall 314-S of the hull 102. On the opposite end of the hull 102 from the transom 302 is the bow 304, or the forward section of the hull 102. Because the hull 102 is formed of a single sheet of corrugated plastic, stern folds 308 are adjacent the transom 302 and forward folds 306 are in the bow 304 with the hull 102 in the deployed position.

Figure 4:
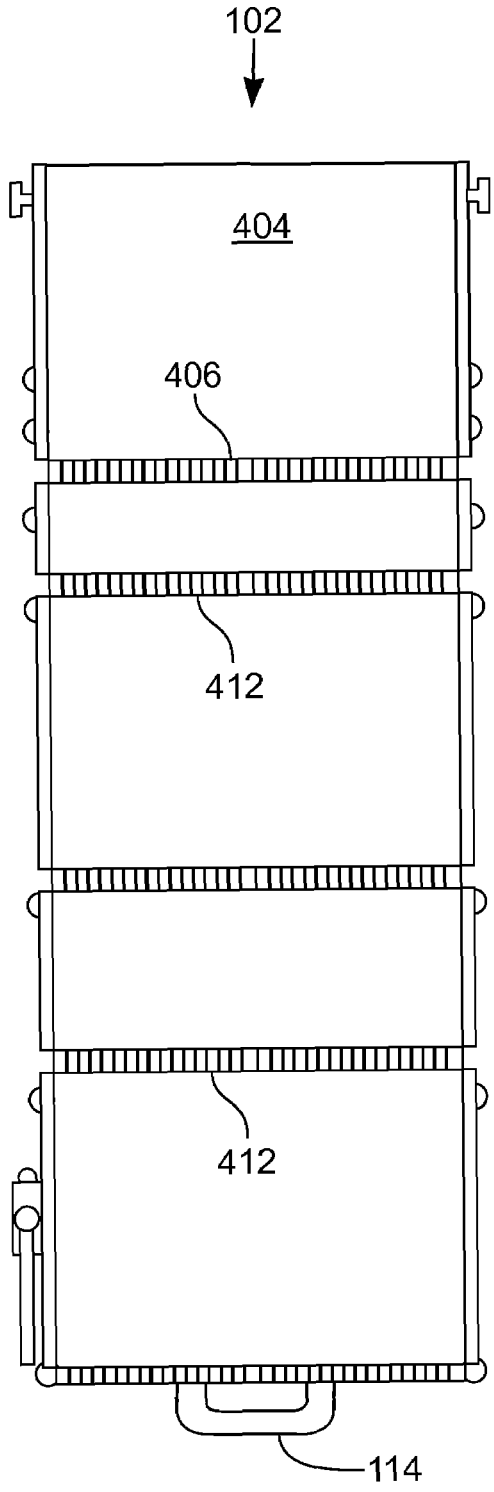
FIG. 4 is a bottom plan view of the hull.

FIG. 4 illustrates a bottom plan view of the hull 102. Visible on the upper surface of the inside of the hull 102 in FIG. 3 are fold creases 312 that correspond to the edges of the channel cut joints 412 positioned on the bottom of the hull 102. With the hull 102 in the deployed position, the channel cut joints 412 on the bottom of the hull 102 are flat except for the most forward joint 406, which is slightly hinged, tilting the forward panel section 404 and forming the forward fold 306 at the bow 304.

Figure 5:
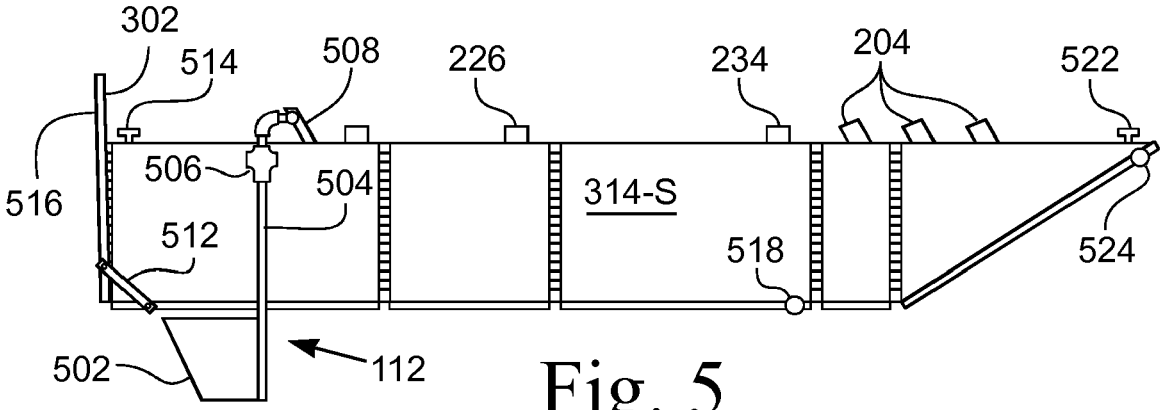
FIG. 5 is a side plan view of the hull.

FIG. 5 illustrates a side plan view of the hull 102. The rudder assembly 112 includes a rudder blade 502 attached to a rudder shaft 504. The rudder shaft 504 rotates and slides within a rudder bearing 506 that is attached to the starboard wall 314-S of the hull 102. The rudder shaft 504 has an upside-down L-shape with the upper end attached to rudder link 508 that attaches to the tiller 126.

The transom 302 has a pair of studs 516 and each wall 314 of the hull 102 has a stud 514. With the transom 302 and side walls 314 positioned in the deployed position, each pair of studs 516, 514 are linked together with a connector (not illustrated). Between the side of the transom 302 and the bottom of the side wall 314 is a brace 512 that rigidly supports the lower portion of the transom 302 relative to the rest of the hull 102.

At the bow 304, the forward end of each side wall 314 has a stud 522 and the forward bottom panel section 404 of the hull 102 has a stud 524. When the forward panel section 404 is tilted up, the two studs 522, 524 are brought near each other and they are linked together with a connector (not illustrated).

Figure 6:
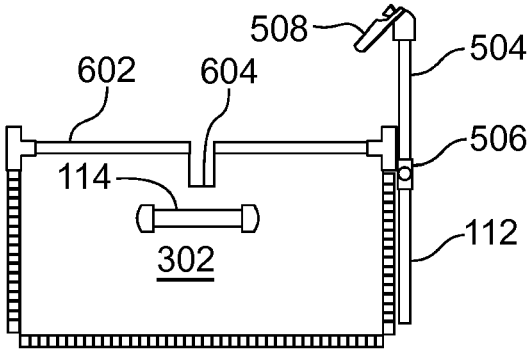
FIG. 6 is a back view of hull showing the transom.

FIG. 6 illustrates a back view of the hull 102 showing the transom 302 and the handle 114 attached to the transom 302. With the hull 102 resting on a surface, the rudder assembly 112 is in an elevated position. The rudder shaft 504 slides within the rudder bearing 506 to prevent the rudder assembly 112 from being damaged when the boat 100 is not in the water. When in the folded position, the rudder assembly 112 is slid within the rudder bearing 506 to ensure that the rudder 502 does not protrude from the hull 102.

The transom 302 includes bars 602 running along the gunwale 206 of the transom 302. In the middle of the top of the transom 302 is a cut-out 604 for receiving a mount for an auxiliary motor, such as an outboard or trolling motor. Those skilled in the art will recognize that the shape, size, and need for a cut-out will vary depending upon the requirements of the auxiliary motor and can vary without departing from the spirit and scope of the present invention.

Figure 7:
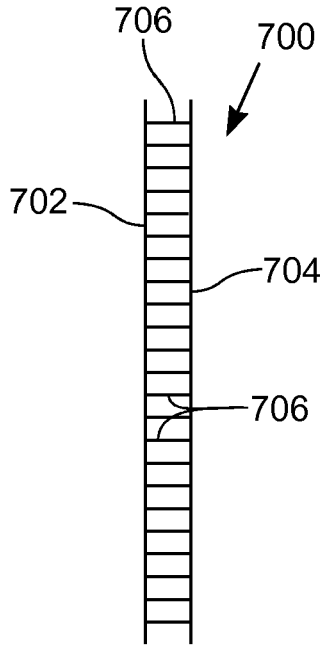
FIG. 7 is an end view of a section of the corrugated plastic sheet.

FIG. 7 illustrates an end view of a piece of the corrugated plastic sheet 700. Many portions of the boat 100 are fabricated from a corrugated plastic sheet, which in one embodiment is an extruded twin-wall plastic sheet of high impact polypropylene copolymer, such as Coroplast. The copolymer resin allows the material to repeatedly flex and act as a hinge without breaking or cracking. The sheet 700 has a first surface, or wall, 702 and a second surface, or wall, 704 with a plurality of flutes 706 joining the two surfaces 702, 704 at regular intervals. The flutes 706 are parallel to each other in a spaced apart configuration and perpendicular to the first and second surfaces 702, 704. The first surface 702 and the second surface 704 are thin sheets of plastic. Those skilled in the art will recognize that, when discussing the sheet 700, the first surface 702 and the second surface 704 are interchangeable.

Figure 8:
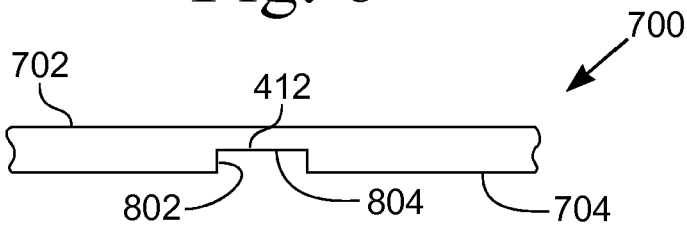
FIG. 8 is an end view of a channel cut joint.
Figure 9:
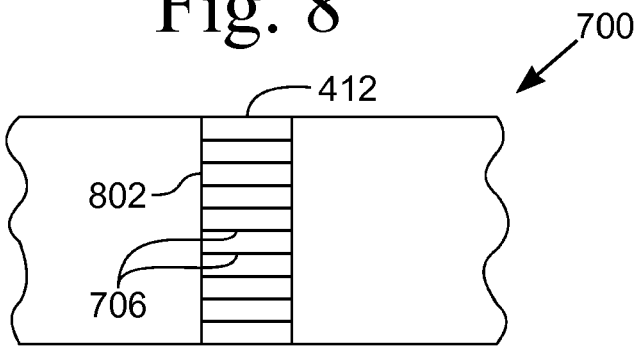
FIG. 9 is a front view of the channel cut joint.

FIG. 8 illustrates an end view of a channel cut joint 412. FIG. 9 illustrates a front view of the channel cut joint 412. The channel cut joint 412 has a rectangular section of the second surface 704 removed, along with a portion of the flutes 706 adjacent the removed piece of the second surface 704. The channel cut joint 412 has inside side walls 802 and an inside back wall 804, forming a channel in the corrugated sheet 700. The channel cut 412, by virtue of the flutes 706 not being completely cut away at the joint 412, maintains rigidity of the sheet 700 and prevents the two inside walls 802 from coming together in the plane of the sheet 700 when the sheet 700 is flat.

The channel cut joint 412 allows the sheet 700 to fold such that the first surface 702 is adjacent to itself and to also fold such that the second surface 704 is adjacent to itself. That is, the joint 412 is a hinge that allows one portion of the sheet 700 to fold in either direction. The channel cut joint 412 is used in the boat 100 where the sheet 700 is folded upon itself and the double layer of sheet 700 is then folded.

Figure 10:
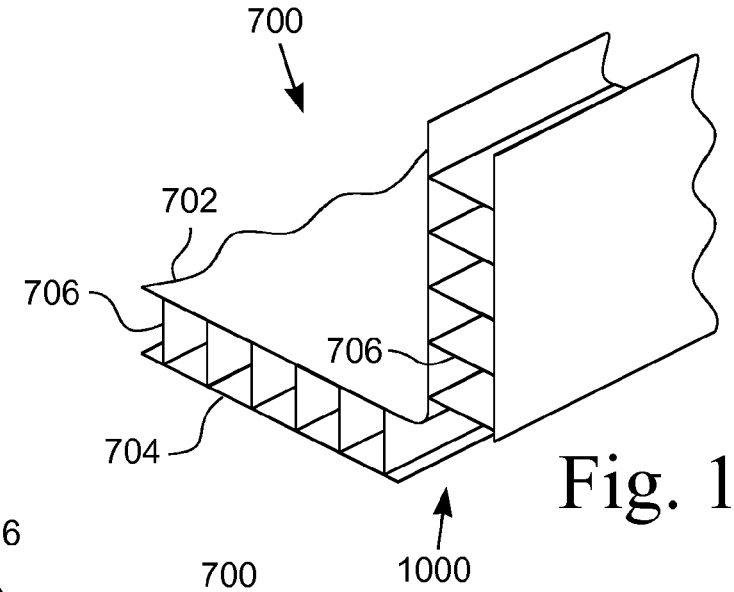
FIG. 10 is a perspective view of a parallel flute half-cut joint.

FIG. 10 illustrates a perspective view of a parallel flute half-cut joint 1000. The parallel flute joint 1000 is a joint formed with the second surface 704 of the sheet cut in a direction parallel to the flutes 706 of the sheet 700. The parallel flute joint 1000 forms a hinge with the first surface 702 flexing and bending between the flutes 704 on opposite sides of the cut in the second surface 704. The parallel flute joint 1000 is one type of half-cut joint.

Figure 11:
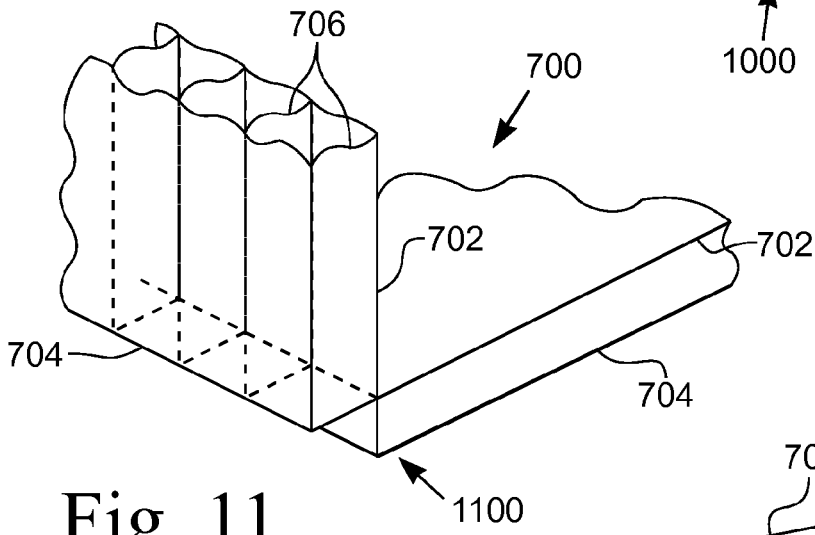
FIG. 11 is a perspective view of one embodiment of a cross-flute half-cut joint.
Figure 12:
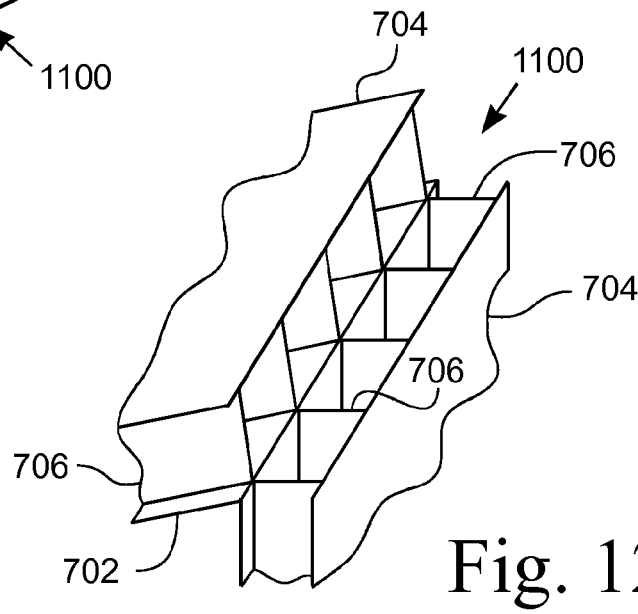
FIG. 12 is another perspective view of the cross-flute half-cut joint.

FIG. 11 illustrates a perspective view of one embodiment of a cross-flute half-cut joint 1100. FIG. 12 illustrates another perspective view of the cross-flute half-cut joint 1100. The cross-flute joint 1100 is a joint formed with the second surface 704 and the adjacent flutes 706 cut in a direction substantially perpendicular to the flutes 706 and all the way to the first surface 702, but not cutting the first surface 702. The cross-flute joint 1100 forms a hinge with the first surface 702 flexing and bending. The cross-flute joint 1100 is one type of half-cut joint.

Figure 13:
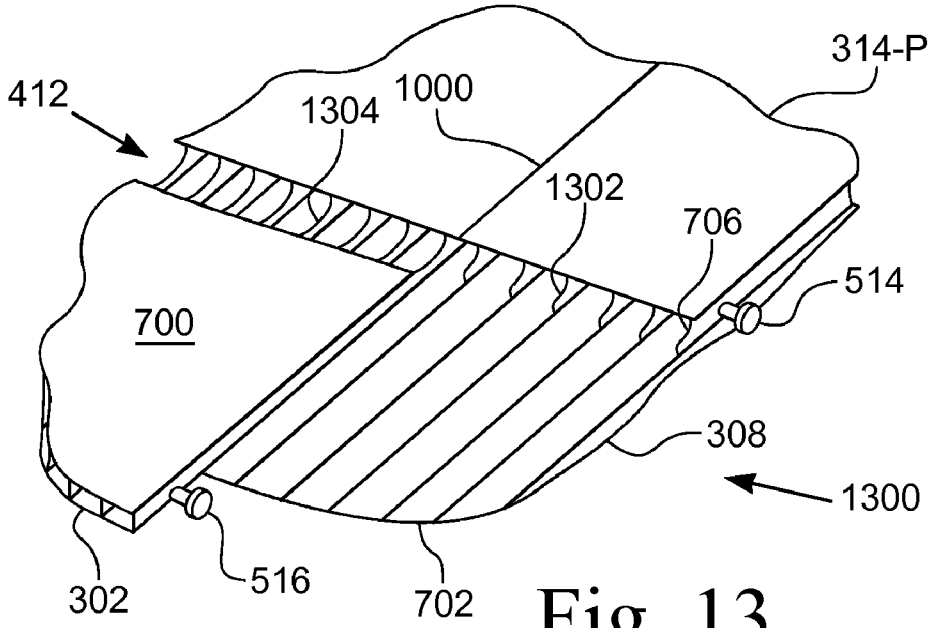
FIG. 13 is a perspective bottom view of a face cut adjacent the transom.

FIG. 13 illustrates a perspective bottom view of a right-angle face cut joint 1300 adjacent the transom 302 showing a stern fold 308. The face cut joint 1300 is formed by removing a section of the second surface 704 of the corrugated sheet 700 and removing the flutes 706 adjacent to the removed section of the second surface 704. The first surface 702 remaining in the face cut joint 1300 forms the stern fold 308, which is a flexible joint that allows a side of the transom 302 to be adjacent the rear edge of the starboard wall 314-S. A parallel flute joint 1000 between the side wall 314-S and the remainder of the hull 102 is illustrated perpendicular to the channel cut 412 between the transom 302 and the remainder of the hull 102.

Also illustrated in FIG. 13 are the studs 514, 516 protruding from the ends of the corrugated sheet 700. In the deployed position, the studs 514, 516 are linked together, thereby securing the side walls 314 of the hull 102 to the transom 302. In one embodiment, the studs 514, 516 are linked by a member with two holes with each hole engaging one of the studs 514, 516.

Figure 14:
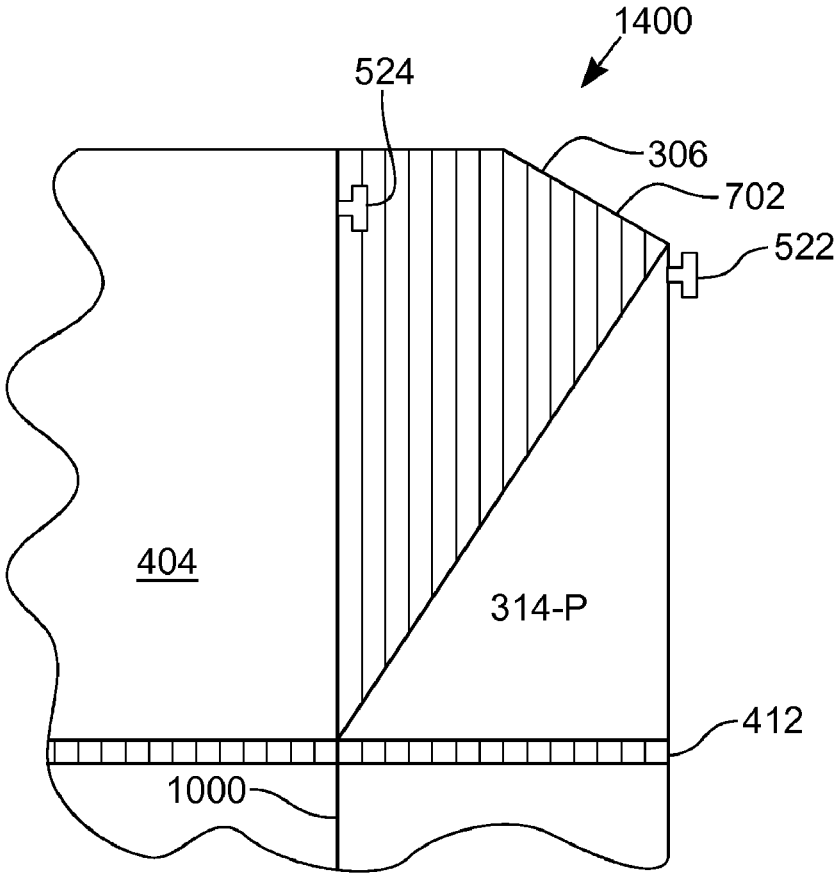
FIG. 14 is a bottom plan view of a face cut at the bow of the boat.

FIG. 14 illustrates a bottom plan view of an angled face cut joint 1400 at the bow 304 of the boat 100 showing a forward fold 306, where the second surface 704 and a portion of the flutes 706 have been removed. The first surface 702 remaining in the face cut joint 1400 forms a forward fold 306, which is a flexible joint that allows a side of the forward panel 404 to be adjacent the forward edge of the starboard wall 314-S when the hull 102 is in the deployed position.

Also illustrated in FIG. 14 are the studs 522, 524 protruding from the ends of the corrugated sheet 700. In the deployed position, the studs 522, 524 are linked together, thereby securing the forward panel 404 of the hull 102 to the side walls 314 of the hull 102. In one embodiment, the studs 522, 524 are linked by a member with two holes with each hole engaging one of the studs 522, 524.

The illustrated joints 412, 1000, 1100, 1300, 1400 in the corrugated sheet 700 allow the various components of the boat 100 to assume the deployed shape as illustrated in FIGS. 1-6 and to also assume the folded shape illustrated in the later figures. The channel cut joint 412 allows for a wide hinge joint and also allows for a hinge that flexes two ways. The parallel flute joint 1000 and the cross-flute joint 1100 form hinges with a well-defined hinge line, although the hinge line of the parallel flute joint 1000 is wider than that of the cross-flute joint 1100, which is constrained by the cut flutes 706. The face cut joints 1300, 1400 are joints that flex and bend such that the material of the first surface 702 is positioned out of the way as the sheet 700 is placed in various positions and configurations. The edges of the sheet 700 adjacent the face cut joint 1300, 1400 are minimally constrained from moving, that is, the first surface 702 in the joint 1300, 1400 that forms the folds 306, 308 allow the sheet 700 to fold and form an inside corner with three walls. Stability of the walls adjacent the joints 1300, 1400 is provided by securing the bow 304 with the corresponding pair of studs 522, 524 linked together and by securing the transom 302 with the corresponding pair of studs 516, 514 linked together.

Figure 15:
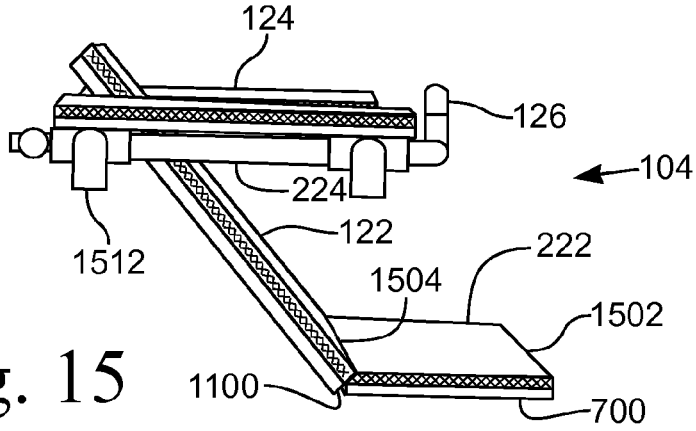
FIG. 15 is a perspective view of the seat in the deployed position.
Figure 16:
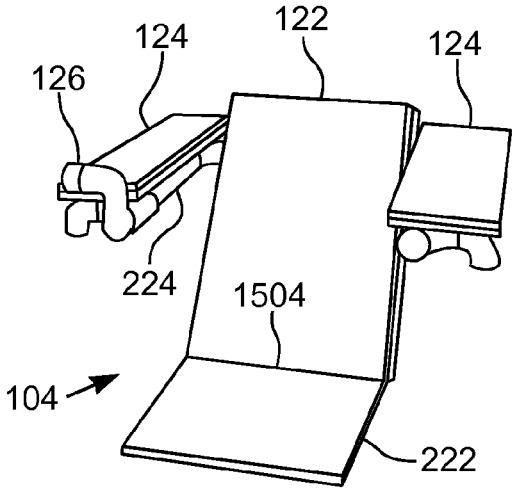
FIG. 16 is a perspective view of the seat.
Figure 17:
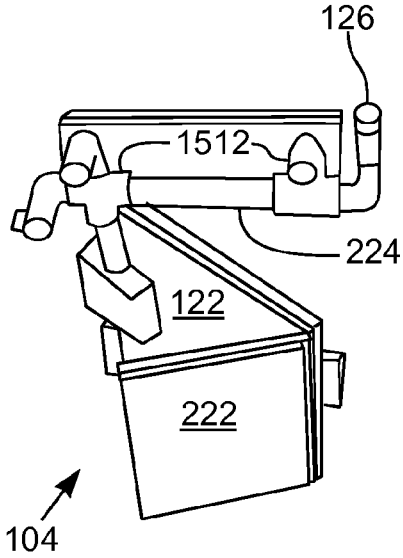
FIG. 17 is a perspective bottom view of a partially folded seat.
Figure 18:
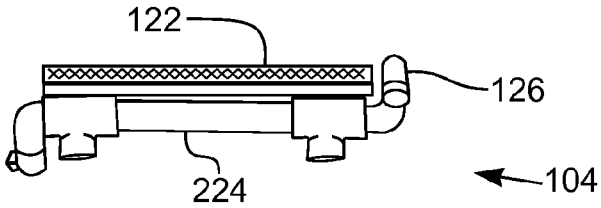
FIG. 18 is a side view of a seat in the folded position.

FIG. 15 illustrates a perspective view of the seat 104 in the deployed position. FIG. 16 illustrates a perspective view of the seat 104. FIG. 17 illustrates a perspective bottom view of a partially folded seat 104. FIG. 18 illustrates a side view of a seat 104 in the folded position. The seat back 122, the seat bottom 222, and the arm rests 124 are made of a base layer of corrugated sheet 700 and an upper layer 1502 that is a soft, resilient material, such as a foam. An upper layer 1502 of closed-cell foam provides comfort and also provides flotation because it displaces water.

The seat back 122 and seat bottom 222 has a hinge joint 1504 that includes two closely spaced cross-flute joints 1100 that allow the seat back 122 and bottom 222 to hinge in two directions. In one direction, the seat 104 is deployed and in the other direction, illustrated in FIGS. 17 and 18, the seat 104 is folded with the base layers 700 adjacent.

The seat frame 224 has four connectors 1512 that mate with the connectors 226 on the hull 102. The two connectors 1512 attached to the arm rest 124 adjacent the tiller 126 have bushings that allow the tiller 126 to rotate. The tiller 126 is illustrated in various rotated positions in FIGS. 15-18. The Tiller 126 is dimensioned and configured to be grasped in one hand and rotated to cause the rudder 112 to rotate within the rudder bearing 506.

Figure 19:
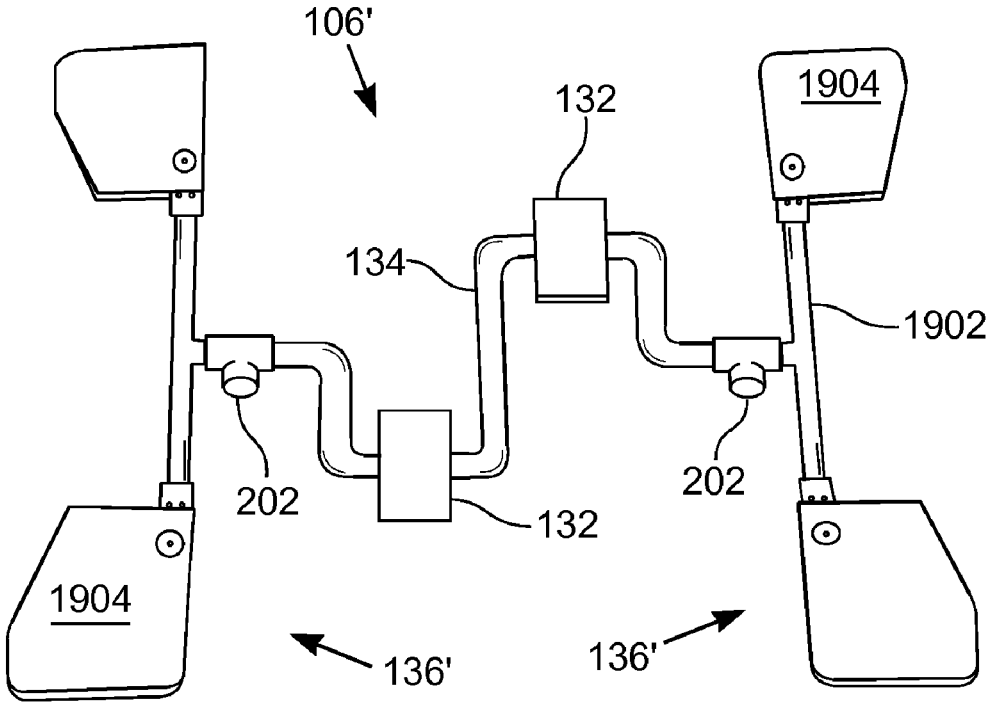
FIG. 19 is a view of another embodiment of a paddle assembly.

FIG. 19 illustrates a view of another embodiment of a paddle assembly 106'. The opposite ends of the crankshaft 134 have bearing connectors 202. The bearing connector 202 has a bushing that allows the crankshaft 134 to rotate and the bearing connector 202 also has an interface to the connector 204 on the hull 102. The pedals 132 freely rotate on the crankshaft 134. The illustrated embodiment of the paddle assembly 106' has a pair of paddles 136' each with only two blades, or paddle blades, 1904 attached to a paddle strut, or shaft, 1902. The paddles 136' are illustrated in the deployed position.

Figure 20:
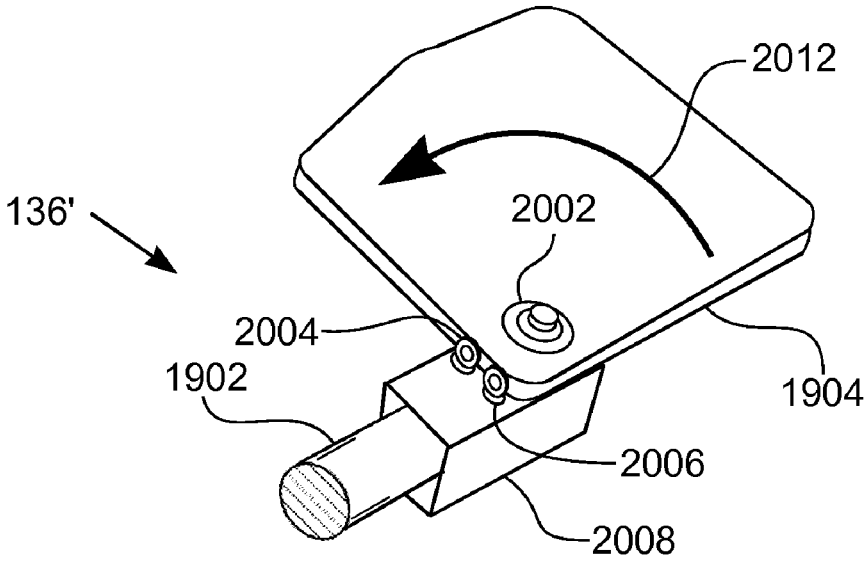
FIG. 20 is a partial view of one embodiment of a paddle.

FIG. 20 illustrates a partial view of one embodiment of a paddle 136'. The blades 1904 pivot about a shaft 2002 that secures the paddle 1904 to the shaft 1902. The paddle 1904 has a pair of protrusions 2004 that engage depressions or holes 2006 in a shaft end-piece 2008. The blade 1904 is illustrated in the deployed position. In the folded position, the blade 1904 rotates 2012 such that the blade 1904 does not protrude outboard of the shaft, or strut, 1902.

Figure 21:
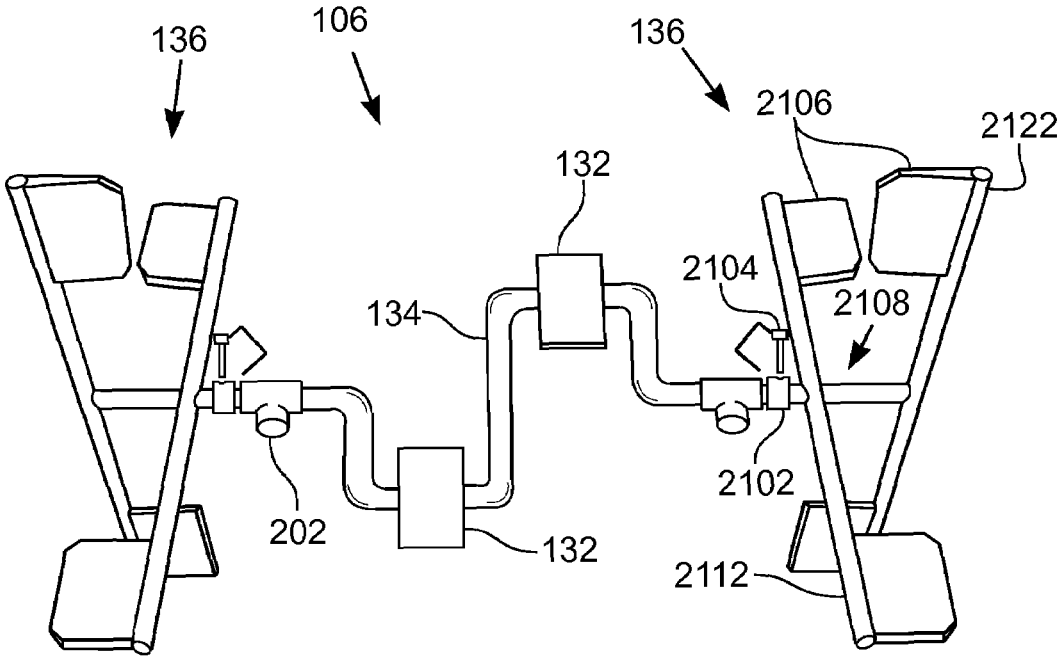
FIG. 21 is a perspective view of one embodiment of the paddle assembly.

FIG. 21 illustrates a perspective partially exploded view of one embodiment of the deployed paddle assembly 106 as illustrated in FIGS. 1 and 2. The two paddles 136 are detachable from the crankshaft 134 at a shaft connector 2102 by removing a pin 2104. Each paddle 136 includes a pair of paddle shafts 2112, 2122 with a blade 2106 fixed at each end. The blades 2106 are attached to the shafts 2112, 2122 in a fixed position.

Figure 22:
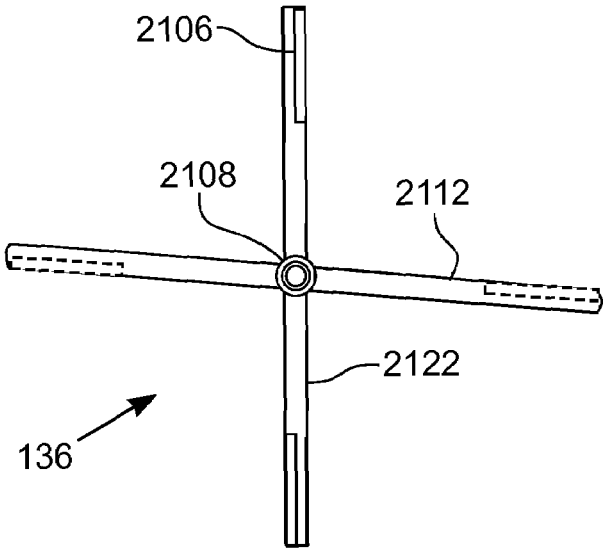
FIG. 22 is a side view of a paddle in the deployed position.
Figure 23:
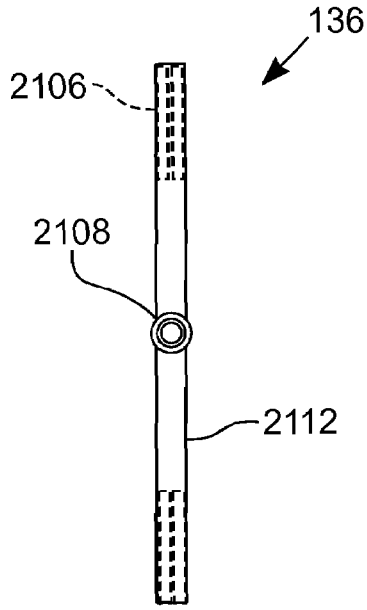
FIG. 23 is a side view of a paddle in a folded position.

FIG. 22 illustrates a side view of a paddle 136 in the deployed, or operating, position. FIG. 23 illustrates a side view of a paddle 136 in a folded, or storage, position. The inboard shaft 2112 rotates relative to the outboard shaft 2122 by virtue of the folding mechanism 2108. In the deployed position, the two shafts 2112, 2122 of the paddle 136 are perpendicular to each other. In the folded position, the two shafts 2112, 2122 are approximately parallel to each other with the paddles 2106 on each shaft 2112, 2122 adjacent to each other.

Figure 24:
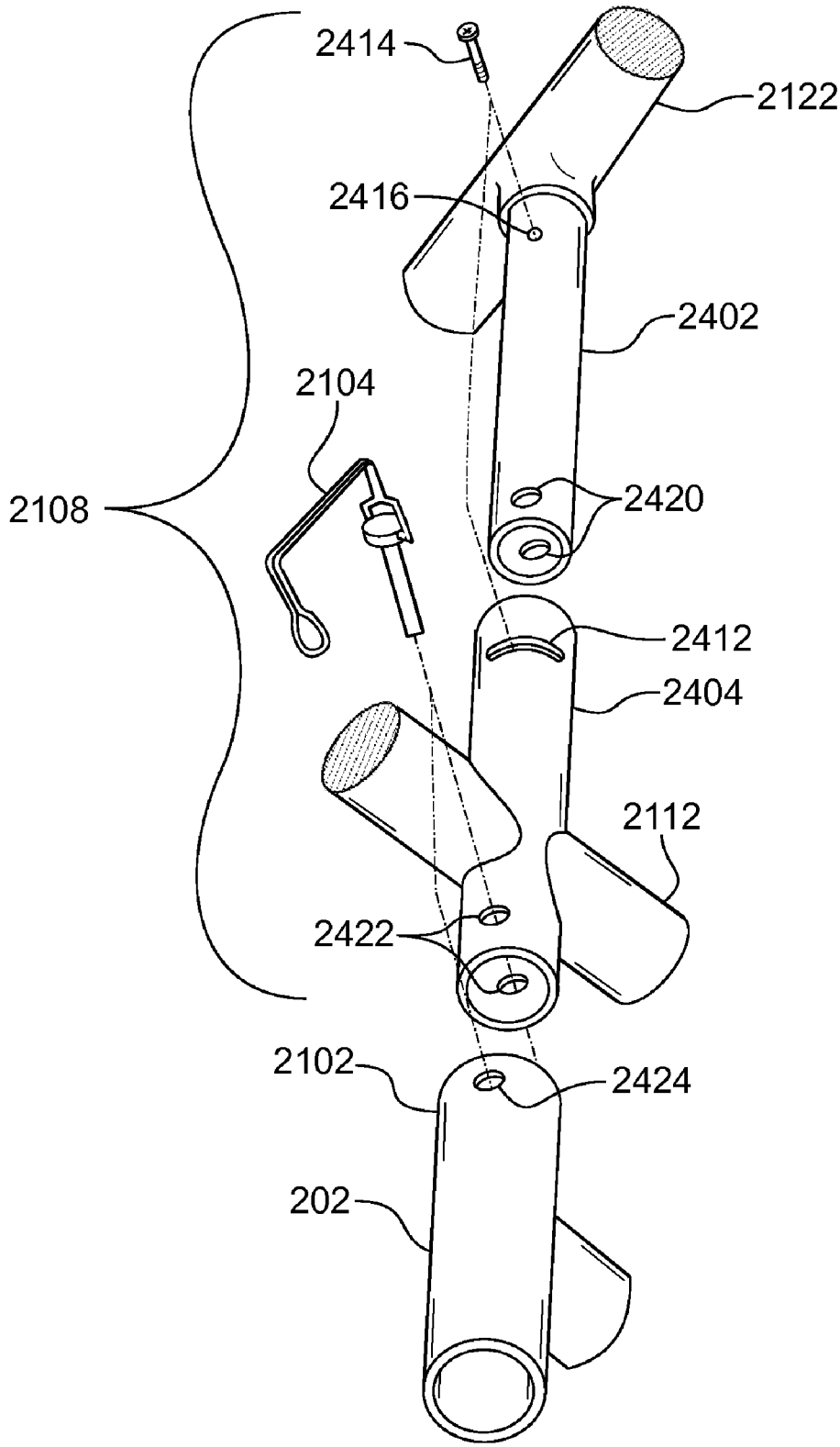
FIG. 24 is an exploded view of the paddle folding mechanism.

FIG. 24 illustrates an exploded view of the paddle folding mechanism 2108. The midpoint of the outboard shaft 2122 is attached to a first shaft 2402 that fits within a second shaft 2404 that is attached to the midpoint of the inboard shaft 2112. The first shaft 2402 has a pair of holes 2420 at the end opposite its connection to the outboard shaft 2122. The second shaft 2404 has a pair of holes 2422 at the end opposite the end adjacent the outboard shaft 2122. The two pairs of holes 2420, 2422 are aligned when the paddle 136 is in the deployed position. Shaft connector 2102 also has a pair of holes 2424 that, when aligned with the two pairs of holes 2402, 2424 in the first and second shafts 2402, 2404, receive pin 2104 to secure the shafts 2402, 2404 in the connector 2102. The pin 2104 is stored in the connector 2102 when the boat 100 is in the folded configuration.

The second shaft 2404 has a slot 2412 and the first shaft has a opening 2416 and a threaded fastener 2414 that engages the opening 2416. When the first and second shafts 2402, 2404 are engaged, the threaded fastener 2414 secured to the first shaft 2412 is within the confines of the slot 2412 in the second shaft 2404, thereby preventing the second shaft 2404 from rotating beyond a certain point relative to the first shaft 2402. In other words, the slot 2412 and fastener 2414 combination function as a rotation stop and as a keeper to ensure that the two shafts 2402, 2404 do not separate.

In one embodiment, the blades 1904, 2106 are not perpendicular to the longitudinal axis of the boat 100 when the blades 1904, 2106 are at their lowest point and in the water. The blades 1904, 2106 are angled such that any spray kicked up by the blades 1904, 2106 as they are operated is directed away from the boat 100 and its occupant.

Figure 25:
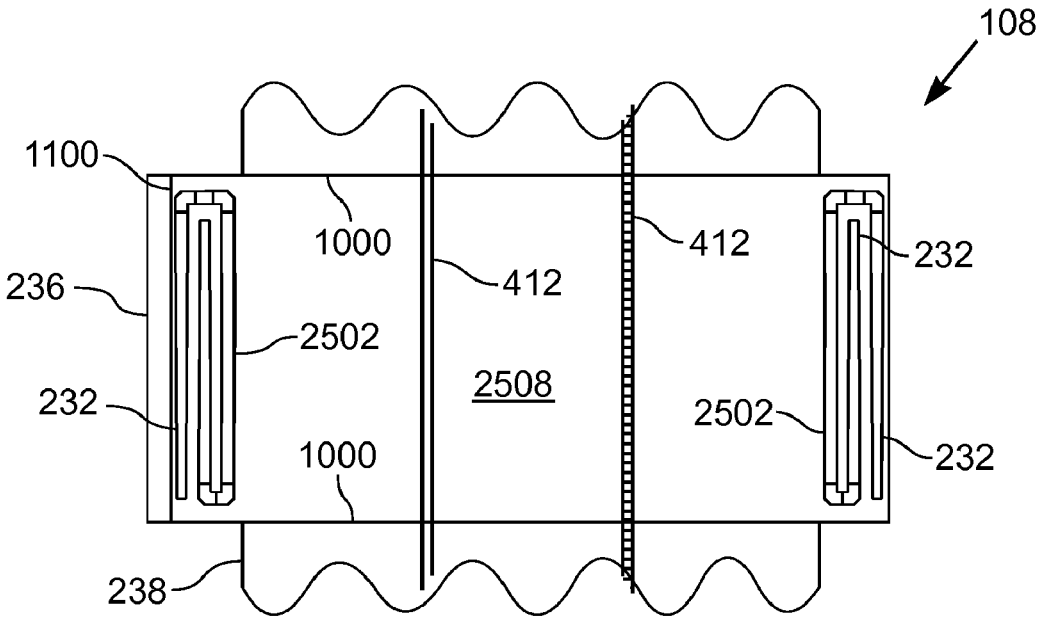
FIG. 25 is a bottom view of the canopy in the partially folded position.

FIG. 25 illustrates a bottom view of the canopy 108 in the partially folded position. The illustrated canopy 108 has the side curtains 238 flat and the support poles 232 folded against the canopy cross-piece 2502. The canopy cross-piece 2502 is a member that extends across the width of the canopy 108 and has swiveling connections to each support pole 232. The canopy cross-pieces 2502 are attached to the underside of the canopy 108 at each end of the canopy 108.

The canopy 108 has two channel cut joints 412 athwartships that divide the canopy 108 into thirds. Each channel cut joint 412 is on opposite sides of the sheet 700 making the canopy 108. Between the center of the canopy 108 and the side curtains 238 are parallel flute joints 1000 and between the center of the canopy 108 and the aft curtain 236 is a cross-flute joint 1100.

Figure 26:
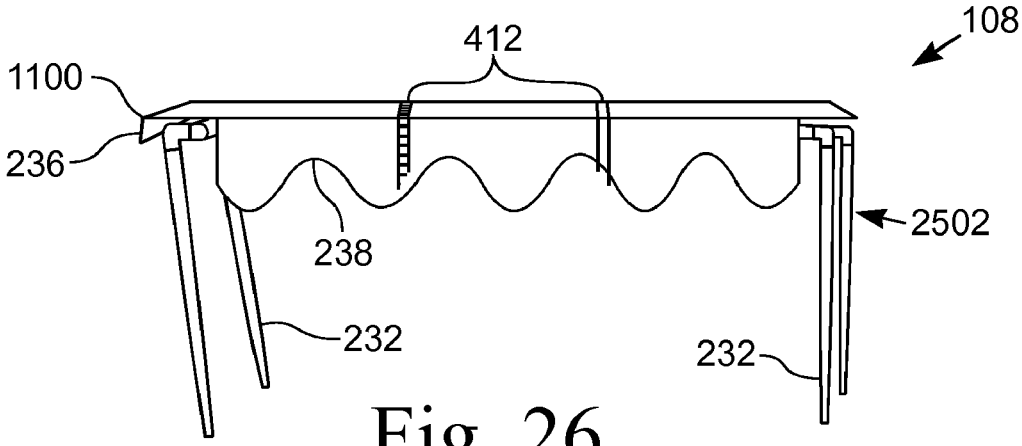
FIG. 26 is a side perspective view of the canopy in the deployed position.

FIG. 26 illustrates a side view of the canopy 108 in the deployed position. The support poles 232 are rotated down. The side curtains 238 hinge downward from the parallel flute joints 1000, and the aft curtain hinges downward from the cross-flute joint 1100. The side curtains 238 are placed in tension and provide support in the stern-to-bow direction and prevent the canopy 108 from drooping.

Figure 27:
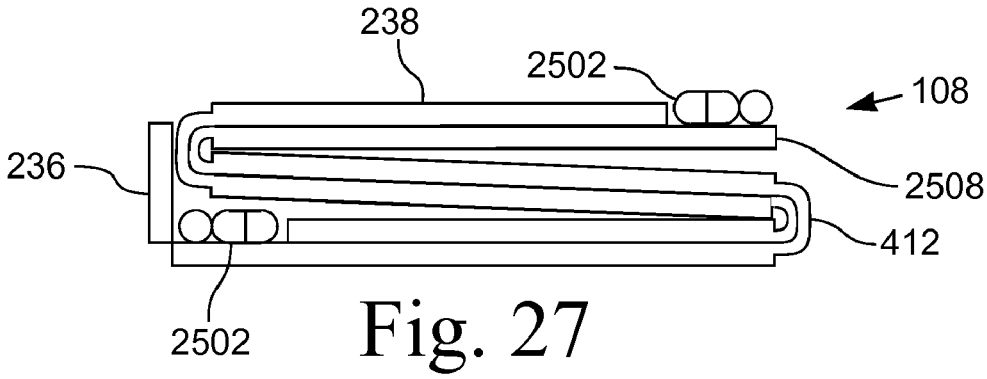
FIG. 27 is a side view of the canopy in the folded position.

FIG. 27 illustrates a side view of the canopy 108 in the folded position. After the canopy 108 is placed in the partial folded position as illustrated in FIG. 25, the side curtains 238 are folded in and positioned adjacent the center portion of the sheet 700 forming the canopy 108. The canopy 108 is then folded into thirds with the center section 2508 of the canopy 108 being in the center with each of the end sections on opposite sides of the center section 2508.

Figure 33:
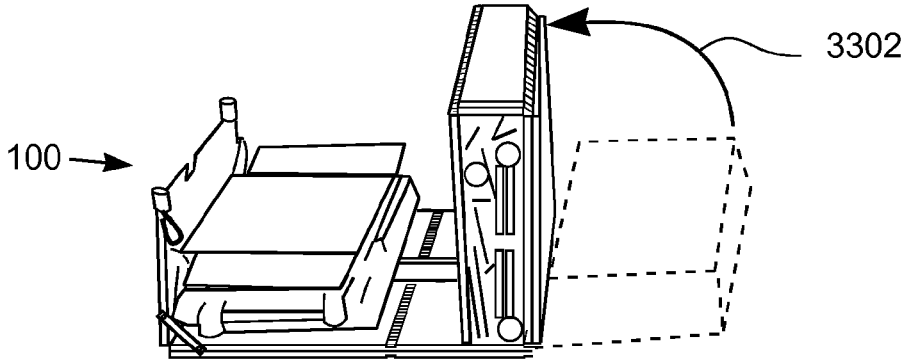
FIG. 33 is a perspective view of the boat in the partially folded position with the midship and forward end of the hull folded.
Figure 34:
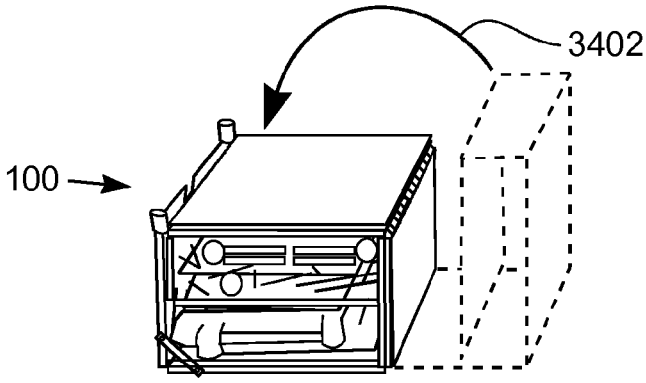
FIG. 34 is a perspective view of the boat in the folded position resting on a side of the folded box-shape.
Figure 35:
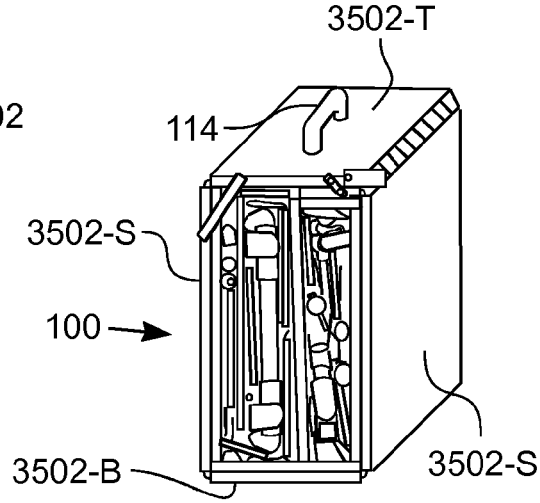
FIG. 35 is a perspective view of one embodiment of the boat in the fully folded position resting on the bottom.

FIGS. 28 to 35 illustrate the steps in folding the boat 100 from the deployed position to the fully-folded position. The deployed position is one in which the boat 100 assumes a boat-shape as illustrated in FIG. 1. The fully-folded position is one in which the boat 100 assumes a box-shape as illustrated in FIG. 35.

Figure 28:
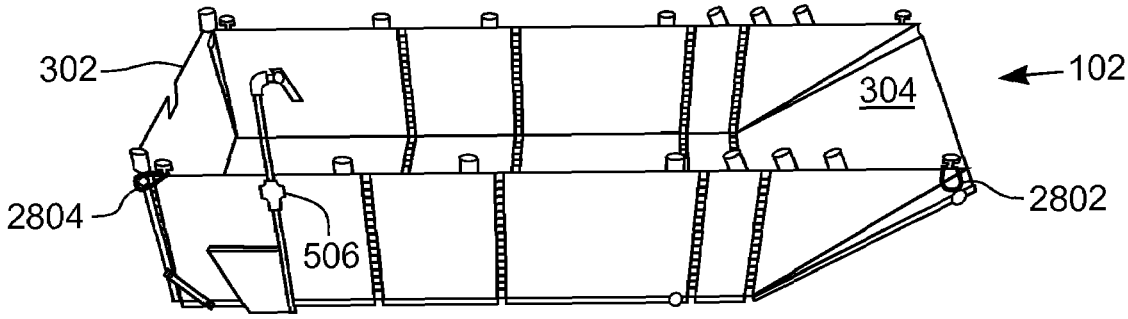
FIG. 28 is a perspective view of the hull in the deployed position.

FIG. 28 illustrates a perspective view of the hull 102 in the deployed position. The rudder assembly 112 is in the upper position because the hull 102 is resting on a surface ready to be folded. At the bow 304 the link 2802 connecting the stud 524 in the forward panel 404 to the stud 522 in the starboard wall 314-S is illustrated. At the transom 302 the link 2804 connecting the stud 516 in the transom 302 to the stud 514 in the starboard wall 314-S is illustrated.

Figure 29:
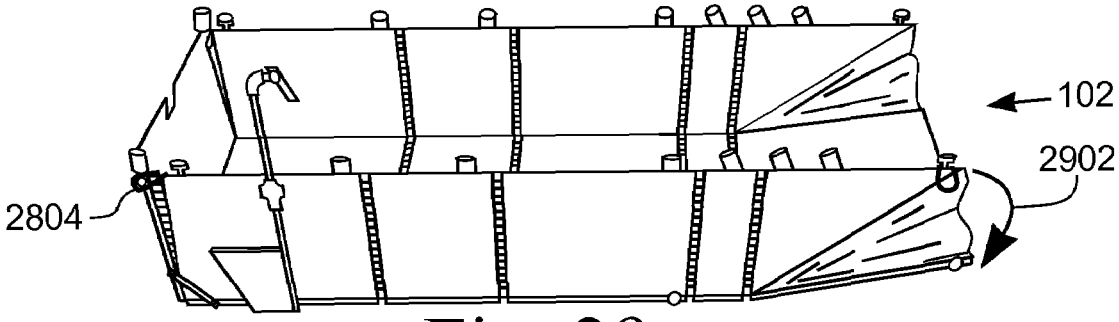
FIG. 29 is a perspective view of the hull with the forward and rear sections released from the deployed position.

FIG. 29 illustrates a perspective view of the hull 102 with the forward panel section 404 released from the deployed position exposing the forward folds 306. The link 2802 connecting the two studs 522, 524 on each side of the bow 304 is disconnected from the stud 524 in the forward panel section 404. The face cut joint 1400 between the side walls 314 and the forward panel section 404 opens and spreads the forward folds 306, allowing the forward panel section 404 to drop down and lie in the same plane as the bottom of the hull 102. The rear link 2804 connecting the two aft studs 514, 516 on each side of the transom 302 is disconnected from the stud 514 in the side wall 314. The face cut joint 1300 between the transom 302 and the side wall 314 begins to open.

Figure 30:
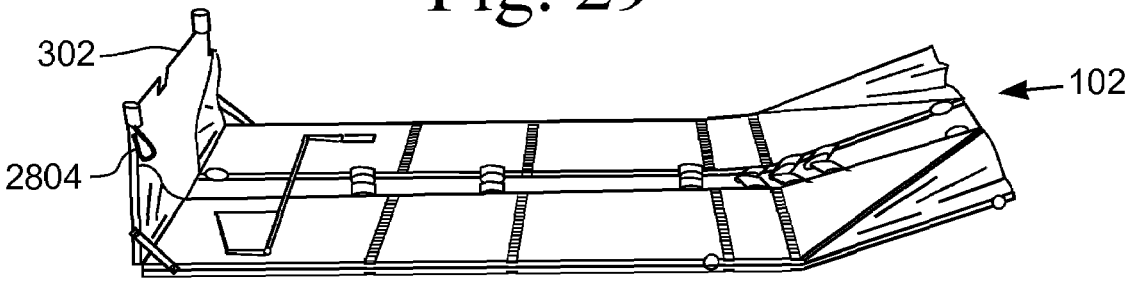
FIG. 30 is a perspective view of the hull in the partially folded position with the side walls folded.

FIG. 30 illustrates a perspective view of the hull 102 in the partially folded position with the side walls 314 folded. With the links 2802, 2804 disconnected, the side walls 314 fold inward and lie adjacent the inside bottom of the hull 102.

Figure 31:
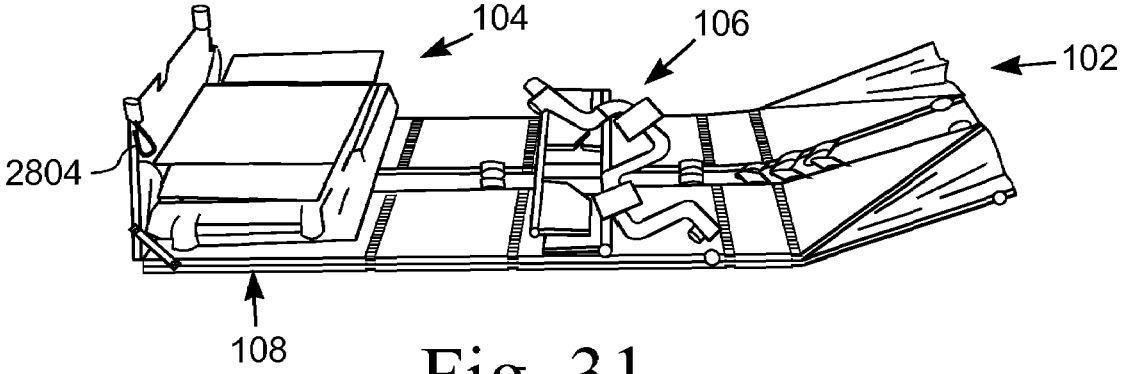
FIG. 31 is a perspective view of the boat in the partially folded position with the four modules positioned together.

FIG. 31 illustrates a perspective view of the boat 100 in the partially folded position with the four modules 102, 104, 106, 108 positioned together. With the side walls 314 folded inward, the canopy 108 and the seat 104 are positioned adjacent the transom 302. Those skilled in the art will recognize that the order of placing the canopy 108 and the seat 104 adjacent the transom 302 can vary without departing from the spirit and scope of the present invention. The paddle assembly 106 is positioned amidships.

Figure 32:
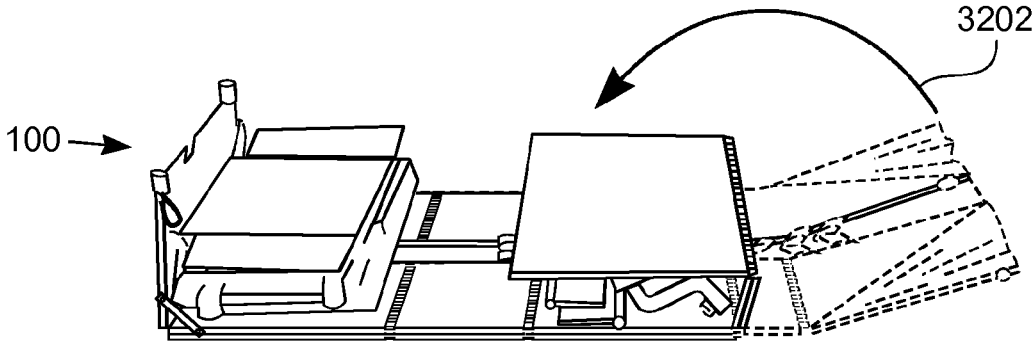
FIG. 32 is a perspective view of the boat in the partially folded position with the forward end of the hull folded.

FIG. 32 illustrates a perspective view of the boat 100 in the partially folded position with the forward end of the hull 102 folded over the paddle assembly 106. The forward end of the forward panel section 404 is lifted and swung 3202 up to a standing position, ready to swing over the paddle assembly 106.

FIG. 33 illustrates a perspective view of the boat 100 in the partially folded position with the midship and forward end of the hull 102 folded. The portion of the boat 100 that is folded around the paddle assembly 106 and is standing upright is swung 3302 over the canopy 108 and the seat 104.

FIG. 34 illustrates a perspective view of the boat 100 in the folded position resting on a side of the folded box-shape. The portion of the boat 100 that is folded around the paddle assembly 106 is lifted and swung 3302 over the canopy 108 and the seat 104. The rear link 2804 is ready to connect the stud 518 in the hull 102 to the stud 516 in the transom 302. The brace 512 between the transom 302 and bottom of the hull 102 fixes two walls of the box-shaped folded boat 100.

FIG. 35 illustrates a perspective view of one embodiment of the boat 100 in the fully-folded position resting on the bottom 3502-B. The fully-folded position of the boat 100 is one that includes four walls 3502 that form a box-shape or a suitcase-shape. The boat 100 in the fully-folded position has a top wall 3502-T, two sides 3502-S, and a bottom 3502-B. The handle 114 is on the top wall 3502-T.

In the illustrated embodiment, the ends are open, exposing the modules 104, 106, 108, which are secured inside the folded hull 102 by the folded configuration of the hull 102. In one embodiment, the fully-folded boat 100 is fitted inside a flexible cover or bag that is secured around the handle 112. In another embodiment, the fully-folded boat 100 includes shoulder straps that allow the fully-folded boat to be carried as a backpack.

The rear link 2804 connects the stud 518 in the hull 102 to the stud 516 in the transom 302, thereby securely wrapping the hull 102 around the other three modules 104, 106, 108. The embodiment illustrated in FIGS. 28-35 does not have a pair of wheels 116 and a pair of legs 118 attached to the hull. The illustrated embodiment is configured to be picked up and carried by the handle 112.

Figure 36:
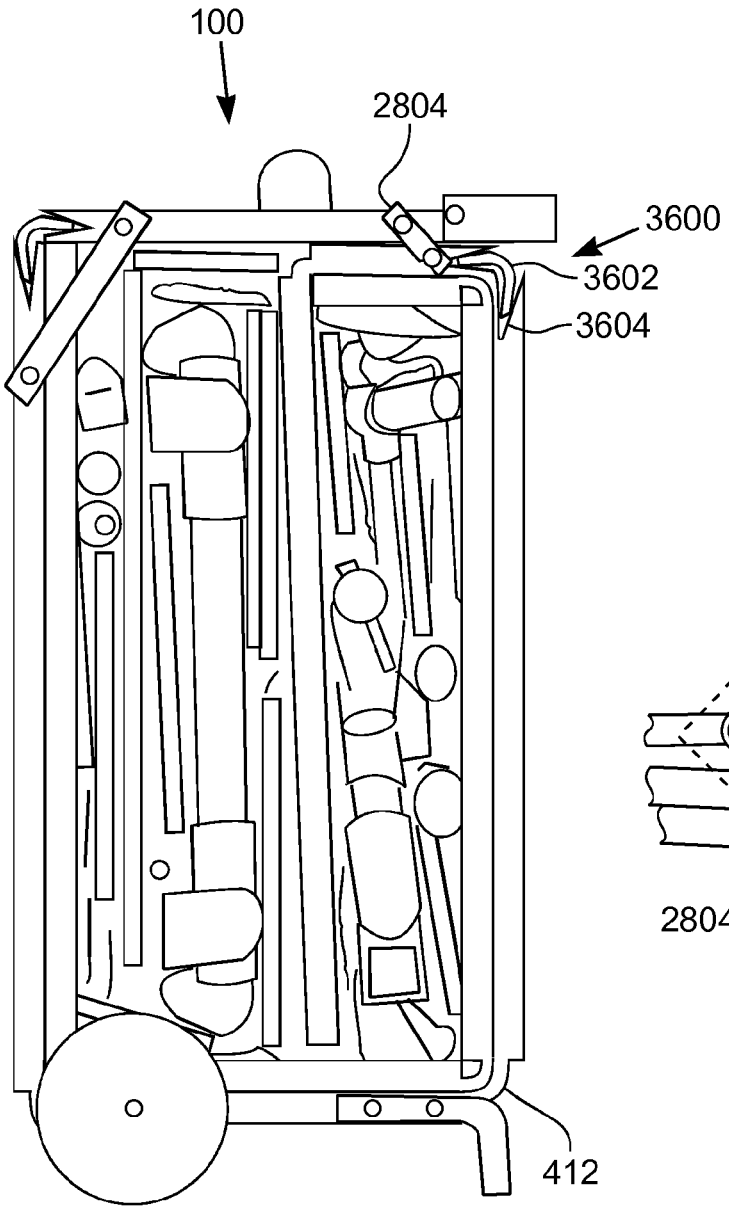
FIG. 36 is a side perspective view of another embodiment of the boat in the fully folded position.

FIG. 36 illustrates a side perspective view of another embodiment of the boat 100 in the fully folded position showing a wheel 116 and a leg 118. The illustrated embodiment is either picked up and carried by the handle 112 or tilted and rolled on the wheels 116.

Figure 37:
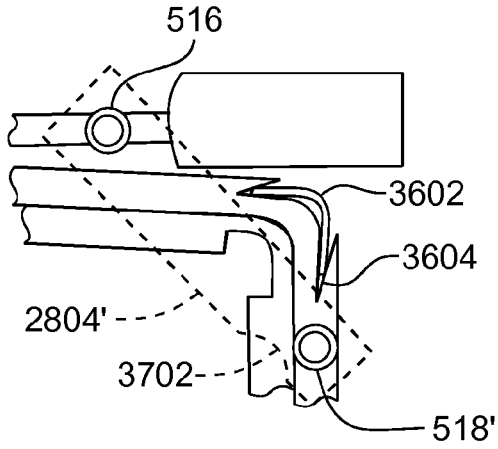
FIG. 37 is a close-up view of a latching connection of the boat in the fully folded position.

FIG. 37 illustrates a close-up view of a latching connection of the boat 100 in the fully folded position. Another embodiment of the rear link 2804' is shown in phantom to show the studs 516, 518'. The illustrated rear link 2804' is a section of tubing with openings positioned to engage the two studs 516, 518. Adjacent the hole engaging the stud 518' is another hole 3702 for engaging the stud 514 attached to the side wall 314. In one embodiment, the studs 514, 516, 518, 522, 524 are fasteners that are threaded, or screwed, into the flutes 706 of the corrugated sheet 700. In the illustrated embodiment, the rear link 2804' is longer than the link 2804 illustrated in FIG. 36 in order to reach the stud 518' on the sidewall 3502-S. The stud 518 illustrated in FIG. 36 is secured in the top 3502-T.

The sheet 700 adjacent the channel cut joints 412 where the sidewalls 314 are folding onto the deck 316 are illustrated in a side view in FIG. 37. The channel cut joints 412 exposed on the outside of the hull 102 in the fully folded position, in one embodiment, have a protective strip 3602 inserted into slits 3604 cut into the flutes 706 adjacent the inside walls 802 of the channel cut joint 412. The strips 3602 cover the exposed flutes 706 that are cut to form the channel cut joint 412. With sufficient depth of the slits 3604, the strips 3602 remain in place as the boat 100 is repeatedly deployed and folded.

Those skilled in the art will recognize that the location and position of the channel cut joints 412 in the hull 102 can be varied to accommodate the number and size of the modules 104, 106, 108 desired to be used with the hull 102 without departing from the spirit and scope of the present invention. For example, if the paddle assembly 106 is not desired, the location of the channel cut joints 412 in the hull 102 can be varied such that the folded boat 100 securely encompasses the remaining modules, which may include the seat 104 and the canopy 108.

Figure 38:
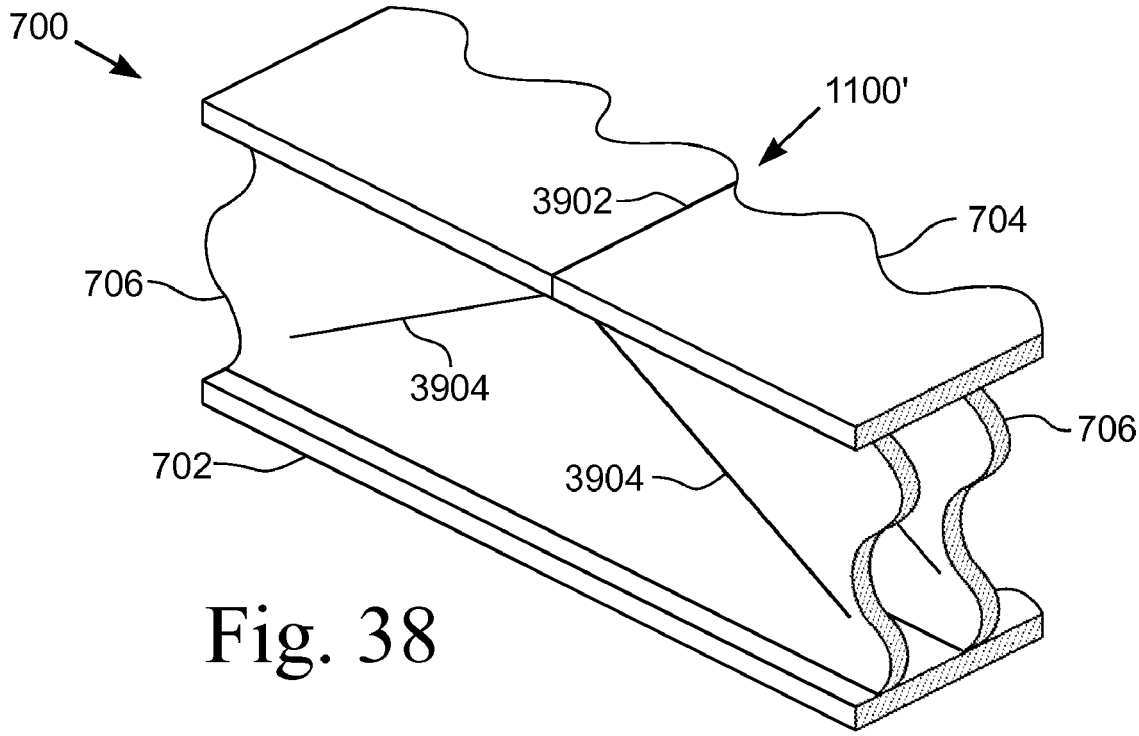
FIG. 38 is a perspective view of another embodiment of a cross-flute half-cut joint.
Figure 39:
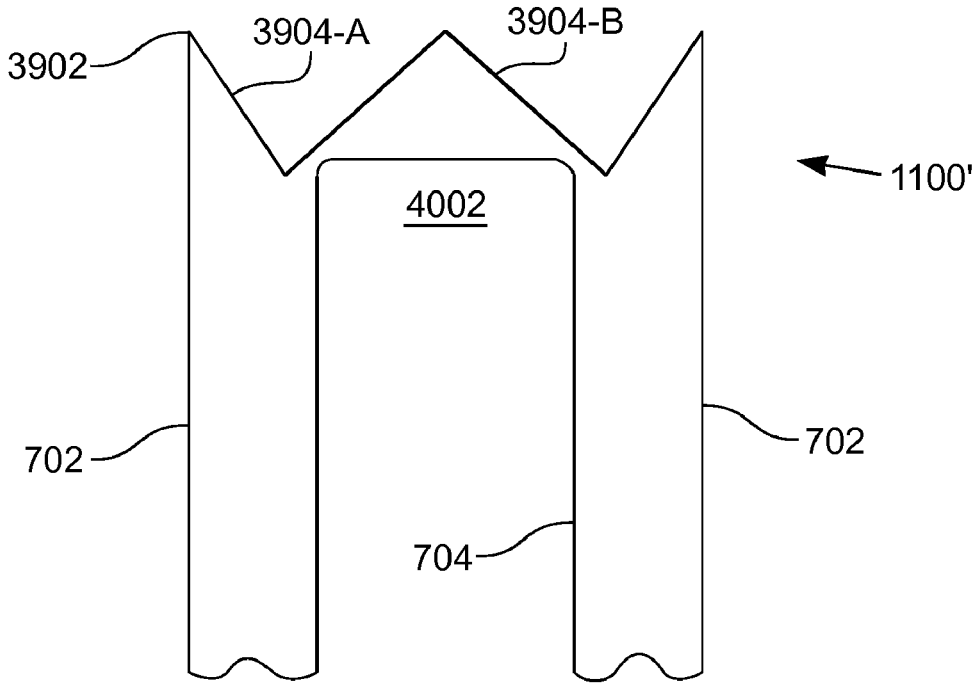
FIG. 39 is a side view of the embodiment of a cross-flute half-cut joint shown in FIG. 38.

FIG. 38 illustrates a perspective view of another embodiment of a cross-flute half-cut joint 1100'. FIG. 39 illustrates a side view of the second embodiment of a cross-flute half-cut joint 1100'. The illustrated embodiment of the cross-flute joint 1100' is a joint formed with the second surface 704 having a cut 3902 a direction substantially perpendicular to the flutes 706 and the adjacent flutes 706 having a pair of cuts 3904 with an inverted V-shape with the apex at the cut 3902 on the second surface 704. The illustrated cross-flute joint 1100' forms a hinge with the first surface 702 flexing and bending to form a U-shaped cavity 4002 between the adjacent first surfaces 702 when the corrugated sheet 700 is folded over as illustrated in FIG. 39. The pair of cuts 3904 have two edges 3904-A, 3904-B that separate and allow the bending stress to be dispersed of a wider area than the embodiment of the cross-flute joint 1100 illustrated in FIGS. 11 and 12.

Figure 40:
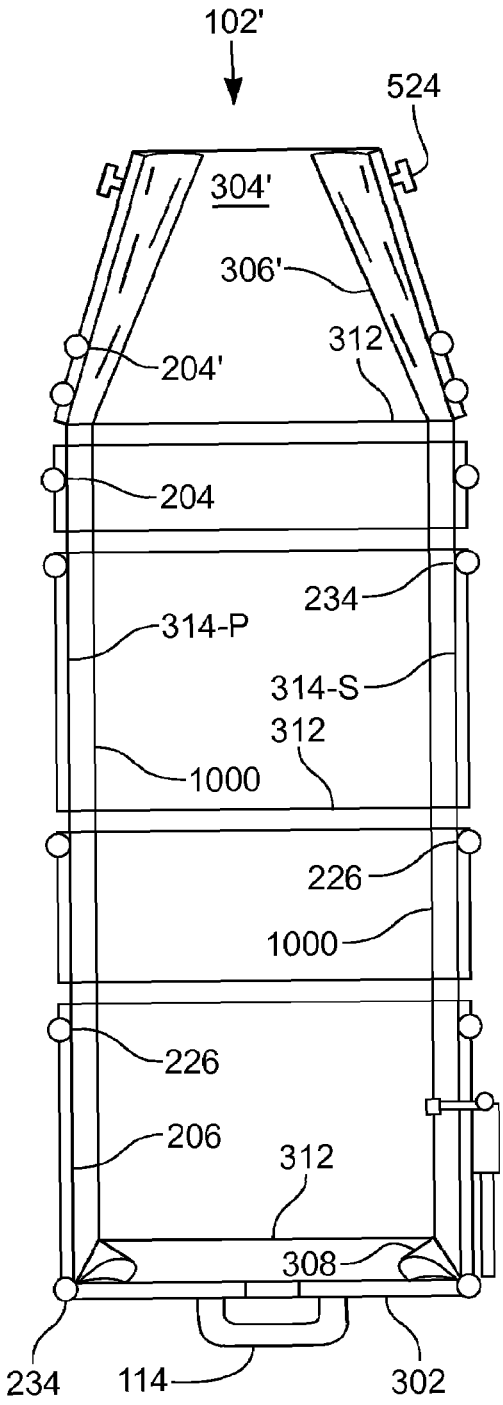
FIG. 40 is another embodiment of a top plan view of the hull.

FIG. 40 illustrates a top plan view of another embodiment of the hull 102' in the deployed position. The illustrated boat hull 102' has a pointed, or blunt-nosed, bow 304' compared to the hull 102 illustrated in FIG. 3, which has a pram's square bow 304. Additionally, the sidewalls 314-S, 314-P and the transom 302 are sloped outward.

Figure 41:
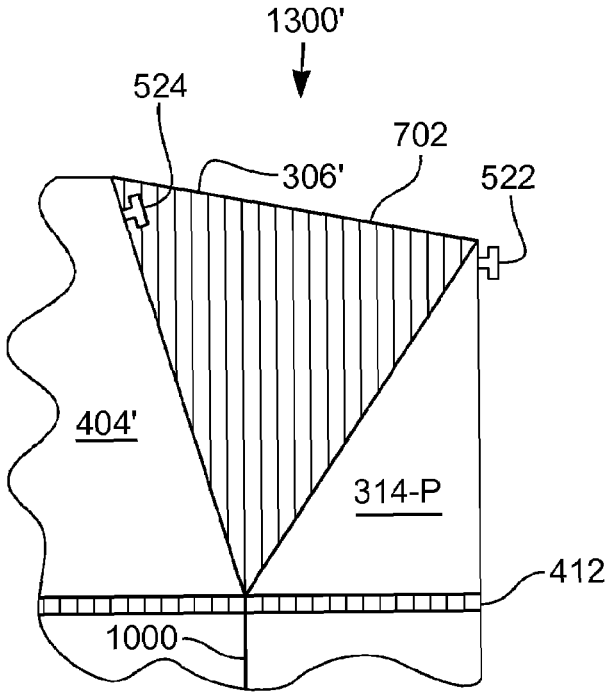
FIG. 41 is a bottom plan view of another embodiment of a face cut at the bow of the boat.

FIG. 41 illustrates a bottom plan view of another embodiment of a face cut 1300' at the bow 304' of the hull 102' with the hull 102' in a flattened, or planar, position. The forward panel 404', unlike the rectangular panel 404 illustrated in FIG. 14, has a trapezoidal shape that is narrower at the forward end than at the aft end. When the adjacent edges of the forward panel 404' and the forward side panels 314-P, 314-S are brought together, the excess portion of the first surface 702 where the second surface 704 and a portion of the flutes 706 have been removed forms the forward fold 306' that is gathered inside the hull 102'.

Figure 42:
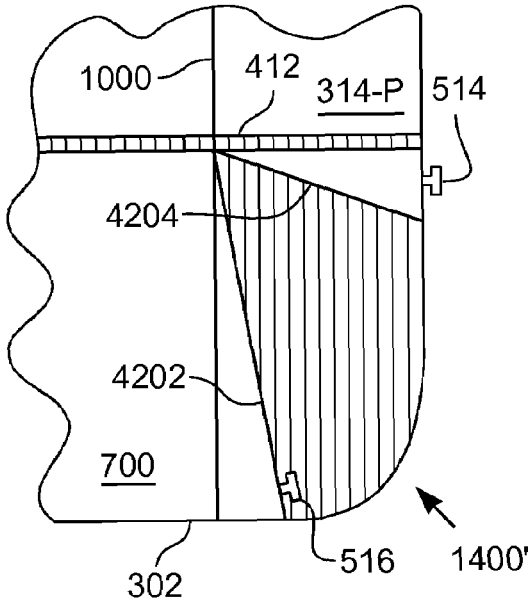
FIG. 42 is a bottom plan view of another embodiment of a face cut adjacent the transom.

FIG. 42 illustrates a bottom plan view of another embodiment of a face cut 1400' adjacent the transom 302. The face cut 1400' is bounded by two edges 4202, 4204 that enable the sidewalls 314 and the transom 302 to have an outward slope when the hull 102' is in the deployed position.

The forward connectors 204, 204', because of the pointed bow 304', are separated with varying gaps. That is, the forward connectors 204 positioned on the portion of the sidewalls 314 that are parallel have the same athwartship gap that the seat connectors 226 and canopy connectors 234 have. The forward connectors 204' positioned on the sidewalls 314 in the bow 304' are progressively closer together the more forward the connectors 204' are located. The forward connectors are positioned to allow the paddle assembly 106 to be positioned fore and aft relative to the seat 104 in order to accommodate the operator comfortably. In order for the paddle assembly 106 to be secured to the hull 102', in one embodiment, the connector halves 202 on the paddle assembly 106 are adjustable athwartships to accommodate the varying distance between corresponding connectors 204, 204'.

The boat 100 includes various functions. The function of maintaining a floating hull 102, 102' is implemented, in one embodiment, by the single corrugated plastic sheet 700 that has integral joints 412, 1000, 1100, 1100', 1300, 1300', 1400, 1400' and an unbroken first surface 702 in the portion of the hull 102, 102' that is exposed to the water in which the hull 102, 102' floats.

The function of forming a floating hull 102, 102' is implemented, in one embodiment, by the corrugated sheet 700 with the various channel cut joints 412, parallel and cross flute joints 1000, 1100, 1100', and face joints 1300, 1300', 1400, 1400' cut into the sheet 700 without puncturing or penetrating one surface 702 of the sheet 700. The function of maintaining the shape of the hull 102, 102' is implemented, in one embodiment, by the rear link 2804 engaging the aft studs 514, 516 and the forward link 2802 engaging the forward studs 522, 524. The function of maintaining the box-shape of the folded boat 100 is implemented, in one embodiment, by the rear link 2804 engaging the studs 516, 518. The function of bendable joints with lateral stability is implemented, in one embodiment, by the channel cut joints 412, the parallel flute joints 1000, and the cross-flute joints 1100, 1100'.

The function of providing motive force is implemented, in one embodiment, by the paddle assembly 106, 106'. The function of protecting the occupant from the elements is implemented, in one embodiment, by the canopy 108.

From the foregoing description, it will be recognized by those skilled in the art that a folding boat 100 has been provided. The folding boat 100 is formed from a single sheet 700 of corrugated plastic with one intact first surface 702 and an opposing surface 704 that is cut away to form various hinges, or joints, 412, 1000, 1100, 1100', 1300, 1300', 1400, 1400'. In some cases the hinges 412 fold in both directions, and in other cases the hinges 1000, 1100', 1100 fold in one direction, that is, folding the sheet 700 causes only one surface 702 of the sheet 700 to become adjacent to itself.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for use on water that is foldable into a compact shape for transport, said apparatus comprising:

a sheet of corrugated material having a generally rectangular shape, said sheet of corrugated material having a first surface, a second surface, and a plurality of parallel flutes connecting said first and second surfaces, said sheet foldable into a first configuration in which said sheet assumes a hull-shape, said sheet foldable into a second configuration in which said sheet assumes a box-shape, in said first configuration said sheet includes a deck, a transom, and a pair of sidewalls, said deck joined to each of said pair of sidewalls and said transom by a first joint, in said second configuration said sheet includes a top, a bottom, and a pair of sidewalls, said sheet having a plurality of second joints connecting said top, said bottom, and said pair of sidewalls, in said second configuration said pair of sidewalls are folded to be positioned adjacent said deck, each one of said plurality of second joints having a channel defined by said first surface, a portion of said plurality of flutes attached to said first surface, and a pair of edges of said second surface, said one of said plurality of second joints being a hinge with a first position in which said first surface on opposite sides of said second joint are adjacent and with a second position in which said second surface on said opposite sides of said second joint are adjacent; and a cross-member releaseably attachable to each one of said pair of sidewalls adjacent a gunwales of each of said pair of sidewalls when said sheet is in said first configuration, said member bridging said pair of sidewalls.

2. The apparatus of claim 1 further including a seat having at least one cross-member dimensioned and configured to releaseably attach to each one of said pair of sidewalls when said sheet is in said first configuration.

3. The apparatus of claim 1 further including a rudder attached to said sheet in said first configuration, said rudder having an operator accessible from a seat releaseably attachable to said sheet when in said first configuration.

4. The apparatus of claim 1 further including a drive mechanism having a crankshaft dimensioned and configured to extend beyond each one of said pair of sidewalls when said sheet is in said first configuration, said crankshaft releaseably connected to each one of said pair of sidewalls wherein said crankshaft is free to rotate about an athwartships axis, said drive mechanism having a first pair of paddles each of which are attached to a corresponding end of said crankshaft.

5. The apparatus of claim 4 wherein said first pair of paddles each include a strut and a pair of blades, a midsection of each strut connected to said crankshaft, each one of said pair of blades rotateably attached to each end of said strut, each one of said pair of blades having an extended position configured for said first configuration of said sheet and a folded position configured for said second position of said sheet.

6. The apparatus of claim 4 wherein said first pair of paddles each include a first strut and a first pair of blades, each one of said first pair of blades attached to an end of said first strut, and further including a second pair of paddles each including a second strut and a second pair of blades, each one of said second pair of blades attached to an end of said second strut, each one of said first struts cooperatively connected to a corresponding one of said second struts, each one of said first and second struts having a deployed position in which said first and second struts are substantially perpendicular and having a folded position in which each said first and second struts are coplanar.

7. The apparatus of claim 1 further including a canopy of corrugated material supported by a frame, said frame releaseably connected to said sheet when said sheet is in said first configuration, said canopy foldable into a first canopy configuration in which said canopy has a top with a set of legs extending between said top and said sheet, and said canopy foldable into a second canopy configuration in which said canopy assumes a substantially planar shape.

8. An apparatus for use on water that is foldable into a compact shape for transport, said apparatus comprising:

a sheet of corrugated material having a generally rectangular shape, said corrugated material having a first surface, a second surface, and a plurality of parallel flutes connecting said first and second surfaces, said sheet foldable into a first configuration in which said sheet assumes a hull-shape, said sheet foldable into a second configuration in which said sheet assumes a box-shape, in said first configuration said sheet includes a deck, a transom, and a pair of sidewalls, said deck joined to each of said pair of sidewalls and said transom by a first joint, and in said second configuration said sheet includes a top, a bottom, and a pair of sidewalls, said sheet having a plurality of second joints connecting said top, said bottom, and said pair of sidewalls, in said second configuration said pair of sidewalls are folded to be positioned adjacent said deck, each said second joint having a channel defined by said first surface, a portion of said plurality of flutes attached to said first surface, and a pair of edges of said second surface, each said second joint being a hinge with a first position in which said first surface of said corrugated material on opposite sides of said second joint are adjacent and with a second position in which said second surface of said corrugated material on said opposite sides of said second joint are adjacent.

9. The apparatus of claim 8 further including a cross-member releaseably attachable to each one of said pair of sidewalls adjacent a gunwales of each of said pair of sidewalls when said sheet is in said first configuration, said member bridging said pair of sidewalls.

10. The apparatus of claim 8 further including a seat having at least one cross-member dimensioned and configured to releaseably attach to each one of said pair of sidewalls when said sheet is in said first configuration.

11. The apparatus of claim 8 further including a rudder attached to said sheet in said first configuration, said rudder having an operator accessible from a seat releaseably attachable to said sheet when in said first configuration.

12. The apparatus of claim 8 further including a drive mechanism having a crankshaft dimensioned and configured to extend beyond each one of said pair of sidewalls when said sheet is in said first configuration, said crankshaft releaseably connected to each one of said pair of sidewalls wherein said crankshaft is free to rotate about an athwartships axis, said drive mechanism having a first pair of paddles each of which are attached to a corresponding end of said crankshaft.

13. The apparatus of claim 12 wherein said first pair of paddles each include a strut and a pair of blades, a midsection of each strut connected to said crankshaft, each one of said pair of blades rotateably attached to each end of said strut, each one of said pair of blades having an extended position configured for said first configuration of said sheet and a folded position configured for said second position of said sheet.

14. The apparatus of claim 12 wherein said first pair of paddles each include a first strut and a first pair of blades, each one of said first pair of blades attached to an end of said first strut, and further including a second pair of paddles each including a second strut and a second pair of blades, each one of said second pair of blades attached to an end of said second strut, each one of said first struts cooperatively connected to a corresponding one of said second struts, each one of said first and second struts having a deployed position in which said first and second struts are substantially perpendicular and having a folded position in which each said first and second struts are coplanar.

15. The apparatus of claim 8 further including a canopy of corrugated material supported by a frame, said frame releaseably connected to said sheet when said sheet is in said first configuration, said canopy foldable into a first canopy configuration in which said canopy has a top with a set of legs extending between said top and said sheet, and said canopy foldable into a second canopy configuration in which said canopy assumes a substantially planar shape.

16. An apparatus for use on water that is foldable into a compact shape for transport, said apparatus comprising:

a sheet foldable into a first sheet configuration in which said sheet assumes a hull-shape, said sheet foldable into a second sheet configuration in which said sheet assumes a box-shape, in said first sheet configuration said sheet includes a deck, a transom, and a pair of sidewalls; and a drive mechanism having a crankshaft and a pair of paddles, said crankshaft dimensioned and configured to extend beyond each one of said pair of sidewalls when said sheet is in said first sheet configuration, said crankshaft releaseably connected to each one of said pair of sidewalls wherein said crankshaft is free to rotate about an athwartships axis, a pair of pedals positioned on opposite sides of said athwartships axis whereby alternating foot pressure applied to said pedals causes said crankshaft to rotate, said pair of paddles having a first paddle configuration in which said pair of paddles are configured to drive said sheet when said sheet is in said first sheet configuration, said pair of paddles having a second paddle configuration in which said pair of paddles are configured to fit in said box-shape when said sheet is in said second sheet configuration; and each one of said pair of paddles including a first strut and a second strut with each one of said first and second struts having a blade attached at each end, said first paddle configuration is a deployed position in which said first and second struts are substantially perpendicular, and said second paddle configuration is a folded position in which each said first and second struts are coplanar.

17. The apparatus of claim 16 further including a seat having at least one cross-member dimensioned and configured to releaseably attach to each one of said pair of sidewalls when said sheet is in said first configuration.

18. The apparatus of claim 16 wherein in said drive mechanism attaches to said sheet at one of a plurality of positions when said sheet is in said first sheet configuration.

19. The apparatus of claim 16 wherein in said first paddle configuration has a blade rotated in a deployed position and said second paddle configuration has a blade rotated into a folded position.

* * * * *